US007874597B2

(12) United States Patent
Tomita et al.

(10) Patent No.: US 7,874,597 B2
(45) Date of Patent: Jan. 25, 2011

(54) AUTOMATIC FORWARD MOVEMENT MECHANISM, SLIDING DOOR MECHANISM, AND DRAWER MECHANISM

(76) Inventors: Shigemitsu Tomita, 4-23-21 Higashiterao, Tsurumi-ku, Yokohama-shi (JP); Mikio Nezu, #403, 21-1 Ishikawa, Fujisawa-shi (JP)

( * ) Notice: Subject to any disclaimer, the term of this patent is extended or adjusted under 35 U.S.C. 154(b) by 902 days.

(21) Appl. No.: 11/727,093

(22) Filed: Mar. 23, 2007

(65) Prior Publication Data

US 2007/0186481 A1 Aug. 16, 2007

(51) Int. Cl.
*E05C 1/02* (2006.01)
*E05B 63/20* (2006.01)

(52) U.S. Cl. ..... 292/137; 292/332; 292/DIG. 4; 312/330.1; 312/333; 312/334.44; 312/319.1

(58) Field of Classification Search ..... 292/137, 292/332, DIG. 4; 312/330.1, 333, 334.44, 312/319.1
See application file for complete search history.

(56) References Cited

U.S. PATENT DOCUMENTS 4,482,175 A * 11/1984 Sugie ..... 292/45
4,616,861 A * 10/1986 Kurosaki ..... 292/6
4,657,291 A * 4/1987 Kurosaki ..... 292/6
4,709,949 A * 12/1987 Umezawa et al. ..... 292/6
4,779,906 A * 10/1988 Kurosaki ..... 292/19
4,785,493 A * 11/1988 Tillmann et al. ..... 16/53
5,090,751 A * 2/1992 Kobayashi ..... 292/71
5,217,262 A * 6/1993 Kurosaki ..... 292/6
5,292,158 A * 3/1994 Kurosaki ..... 292/45
5,997,056 A * 12/1999 Yamagishi ..... 292/341.17
7,393,026 B2 * 7/2008 Ikeda et al. ..... 292/341.15
2009/0230830 A1 * 9/2009 Ng ..... 312/333

FOREIGN PATENT DOCUMENTS

JP H02-286102 A 11/1990
JP H08-021147 1/1996
JP 2001-245738 9/2001
JP 2003-214023 A 7/2003
JP 2004-316412 A 11/2004

* cited by examiner

*Primary Examiner*—Carlos Lugo
(74) *Attorney, Agent, or Firm*—Manabu Kanesaka

(57) ABSTRACT

A movable member moved forward to a predetermined position can automatically move further forward. The mechanism includes first and second connecting members provided in the movable member and an immovable member. The second connecting member includes a catcher for catching the first connecting member and an urging device for urging the catcher. The catcher is arranged to be able to move or relatively move along a moving direction of the movable member, and held in a waiting position while receiving an urging force by the urging device toward a forward movement direction or backward movement direction of the movable member. When the movable member is moved to the predetermined position, the first connecting member is retained by the catcher of the second connecting member, and upon releasing of retention, the movable member is automatically moved forward to the stopped position by the urging force.

9 Claims, 19 Drawing Sheets

AUTOMATIC FORWARD MOVEMENT MECHANISM, SLIDING DOOR MECHANISM, AND DRAWER MECHANISM

BACKGROUND OF THE INVENTION AND RELATED ART STATEMENT

The invention relates to an automatic forward movement mechanism allowing a movable member such as a sliding door, or drawer which was moved forward to a predetermined position to automatically move forward to a stopped position; and to sliding door and drawer mechanisms using the automatic forward movement mechanism described above.

Shock absorbers, such as those shown in Japanese Patent Publication (Tokkai) No. 8-21147, absorb the shock when the sliding door is closed and hits, by putting a depressed and projected part provided in a slider, onto a depressed and projected part provided in a receiving member when the sliding door is moved to the stopped position.

However, in the above-mentioned shock absorbers, when the speed of the movement toward the stopped position of the sliding door is slow, the shock absorbers make the sliding door stop before the sliding door is completely closed.

The present invention has been made such that after the movable member is moved forward to the predetermined position, the movable member is automatically moved forward to a set stopped position reliably.

Further objects and advantages of the invention will be apparent from the following description of the invention.

SUMMARY OF THE INVENTION

In order to solve the problem described above, according to a first invention, a mechanism allowing a movable member which was moved forward to a predetermined position to automatically move forward to a stopped position includes the following structures of (1)-(5).

(1) The mechanism comprises a first connecting member provided in either the movable member or an immovable member; and a second connecting member provided in the other movable member or immovable member.

(2) The second connecting member includes a catcher relative to the first connecting member, and the catcher can move or relatively move along the moving direction of the movable member.

(3) The catcher is held in a waiting position while receiving an urging force toward a forward movement direction or backward movement direction of the movable member.

(4) When the movable member is moved to the predetermined position, the first connecting member is retained by the catcher of the second connecting member, and upon releasing of the retention, the movable member is automatically moved forward to the stopped position by the urging force.

(5) When the movable member which is in the stopped position is moved backward to the predetermined position, the catcher is held in the waiting position again, and the first connecting member can move from the catcher.

When the catcher is provided to be capable of relative movement in the second connecting member, the holding of the catcher is released by moving the movable member to the predetermined position, so that in a state wherein the catcher retaining the first connecting member is stopped, the second connecting member can be moved. Accordingly, the movable member can be automatically moved forward to the stopped position. When the movable member in the stopped position is moved backward and reaches the predetermined position again, the catcher is held in the waiting position again while receiving the urging force. Also, since the first connecting member slips through the catcher, the movable member is never prevented from moving backward.

When the catcher is movably provided in the second connecting member, the catcher releases the holding by moving the movable member to the predetermined position, so that the catcher can travel in a state of retaining the first connecting member. Accordingly, the movable member can be automatically moved forward to the stopped position. When the movable member which is in the stopped position is moved backward and reaches the predetermined position again, the catcher is held in the waiting position again while receiving the urging force. Also, since the first connecting member slips through the catcher, the movable member is never prevented from moving backward.

Also, in order to solve the problem described above, according to the second invention, a mechanism allowing the movable member which was moved forward to the predetermined position to automatically move forward to the stopped position includes the following structures (1)-(10).

(1) The mechanism comprises a striker member provided in either the movable member or immovable member; and a latch unit provided in the other movable member or immovable member.

(2) The latch unit includes a base, catcher, and spring member.

(3) The base includes an internal space which allows the catcher to move or relatively move along the moving direction of the movable member; a fixing portion to the movable member or immovable member; and a fixing portion of one end of the spring member.

(4) The catcher includes a slide base, a retaining member of the striker member, and a lock member.

(5) The slide base includes a first guide groove, and a fixing portion for the other end of the spring member.

(6) The retaining member includes a second guide groove whose back end side is an assembled portion to the slide base, and which intersects diagonally to the first guide groove on the back end side; and a retaining piece which always projects outwardly and is urged in a non-retention position on the front end side.

(7) The lock member is always urged toward an engagement position wherein the lock member is caught on an engagement portion of the base by urging means. The lock member includes an interlocking shaft which passes through the first guide groove and second guide groove.

(8) The spring member is elastically transformed most in the waiting state wherein the lock member of the catcher is caught on the engagement portion of the base.

(9) When the movable member is moved to the predetermined position, the striker member hits the retaining member of the catcher which is in the waiting state, and the retaining member is moved back by a slope of the second guide groove. Also, the lock member is moved to a non-engagement position against the urging force.

(10) The retaining piece of the retaining member is moved in a retention position by being guided by the inner wall of the base, and engaged with the striker member.

When the movable member is moved forward to the predetermined position from the waiting state of the catcher, first, the striker member enters further than the front end of the retaining piece of the retaining member. Next, the striker member hits the retaining member and pulls back the retaining member. When the retaining member is pulled back, the lock member is moved to the non-engagement position by the second guide groove. At the same time, the retaining piece is moved to the retention position, and engaged with the striker member. Since the spring member is elastically transformed most in the waiting state, when the lock member is moved to the non-engagement position, the catcher engaging and holding the striker member is moved or relatively moved inside the internal space of the base. Accordingly, the movable member can be automatically moved forward to the stopped position from the predetermined position.

Also, when the movable member which was automatically moved forward to the stopped position is moved backward, the spring member is elastically transformed again, and when the movable member is moved backward to the predetermined position, the lock member moves to the engagement position by the urging force and is engaged with the engagement portion. By this engagement, the movable member returns to the waiting state. When the movable member continues to be moved backward further from the waiting state, the retaining member is moved forward, and the retaining piece returns to the non-retention position by the urging force. Accordingly, the engagement and holding of the striker member by the retaining member is released, so that the movable member can be moved backward further to the back.

A damper appliance which damps the movement or relative movement of the catcher, may be installed in the latch unit.

In this case, the automatic forward movement of the movable member accompanied by the movement or relative movement of the catcher inside the base by restoring elasticity of the spring member, can be damped.

The immovable member forms a wide groove along the moving direction of the movable member which houses an end portion along the moving direction of the movable member; and a narrow groove formed on the bottom of the wide groove along the moving direction of the movable member. An adjuster piece which enters the narrow groove and can adjust the movement in the direction intersecting the moving direction of the movable member, may be provided in the latch unit.

In this case, the end portion of the movable member is housed in the wide groove in such a way that both side faces of the end portion of the movable member do not contact or strongly contact with the inner wall of the wide groove, so that the movable member can be moved forward and backward along the wide groove. More specifically, if either one of both side faces of the end portion of the movable member contacts the inner wall of the wide groove due to distortion caused in the movable member or immovable member, the adjuster piece is moved and adjusted, thereby dissolving the contacting state. As a result, the movable member can always automatically and appropriately move forward by an action of the spring member.

In the base, in case the engagement between the lock member and engagement portion of the base is disengaged by mistake in the state of not engaging with the striker member, a portion wherein the retaining piece of the retaining member of the catcher which was completely moved inside the base by the urging force of the spring member, may be elastically transformed outwardly.

In this case, when the catcher is completely moved in the state of not engaging and holding the striker member by mistake as mentioned above, the movable member is moved forward to the stopped position, and the striker member is pushed against the retaining piece of the retaining member which is positioned in the retention position by the inner wall of the base. Accordingly, after the retaining piece is moved into the non-retention position while the above-mentioned place of the base is stretched outwardly, the retaining piece is positioned in the retaining position by restoring the elasticity at the position wherein the striker member enters into a position further than the front end of the retaining piece. As a result, a regular operating state wherein the striker member is engaged and held by the catcher can be restored.

Also, if the sliding door mechanism is constituted such that either the striker member or latch unit in the above-explained mechanism is provided on a sliding door side and the other striker member or latch unit is provided on the opening side which is closed by the sliding door, when the sliding door is moved forward to the predetermined position, the sliding door automatically moves after the predetermined position, so that the sliding door can be moved forward to the stopped position, i.e., to a closed position wherein the front end of the sliding door hits a door stop portion. Accordingly, even if the force acted on the sliding door during the closing operation of the sliding door is small, as long as the sliding door is moved forward to the predetermined position, the sliding door can be moved to the stopped position. Also, even if the force acted on the sliding door during the closing operation of the sliding door is too large, the sliding door can be controlled so as not to be bounced and moved backward.

Also, if a drawer mechanism is constituted such that either the striker member or latch unit in the above-explained mechanism is provided on the drawer side and the other striker member or latch unit is provided on the main body side with the drawer, when the drawer is moved forward to the predetermined position, the drawer automatically moves after the predetermined position, so that the drawer can be moved forward to the stopped position, i.e., to a position wherein the drawer is completely housed in the main body. Accordingly, even if the force acted on the drawer during a pushed-in operation of the drawer is small, as long as the drawer is moved forward to the predetermined position, the drawer can be moved to the stopped position. Also, even if the force acted on the drawer during the pushed-in operation of the drawer is too large, the drawer can be controlled so as not to be bounced and moved backward.

According to mechanisms of the invention, after the movable member, sliding door as the movable member, and drawer as the movable member are moved forward to the predetermined position, they can be automatically moved forward and reliably moved to a set stopped position.

DETAILED DESCRIPTION OF PREFERRED EMBODIMENTS

Hereunder, preferred embodiments of the invention will be explained with reference to FIGS. 1-20.

Figure 1:
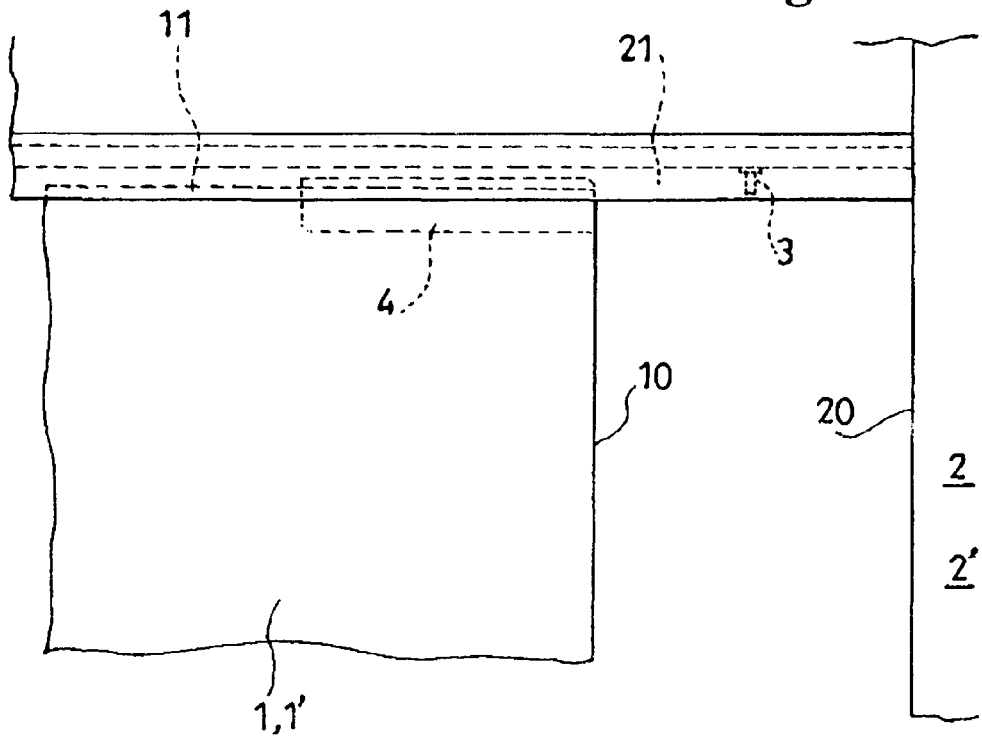
FIG. 1 is a structural view illustrating an applied example of an automatic forward movement mechanism.
Figure 2:
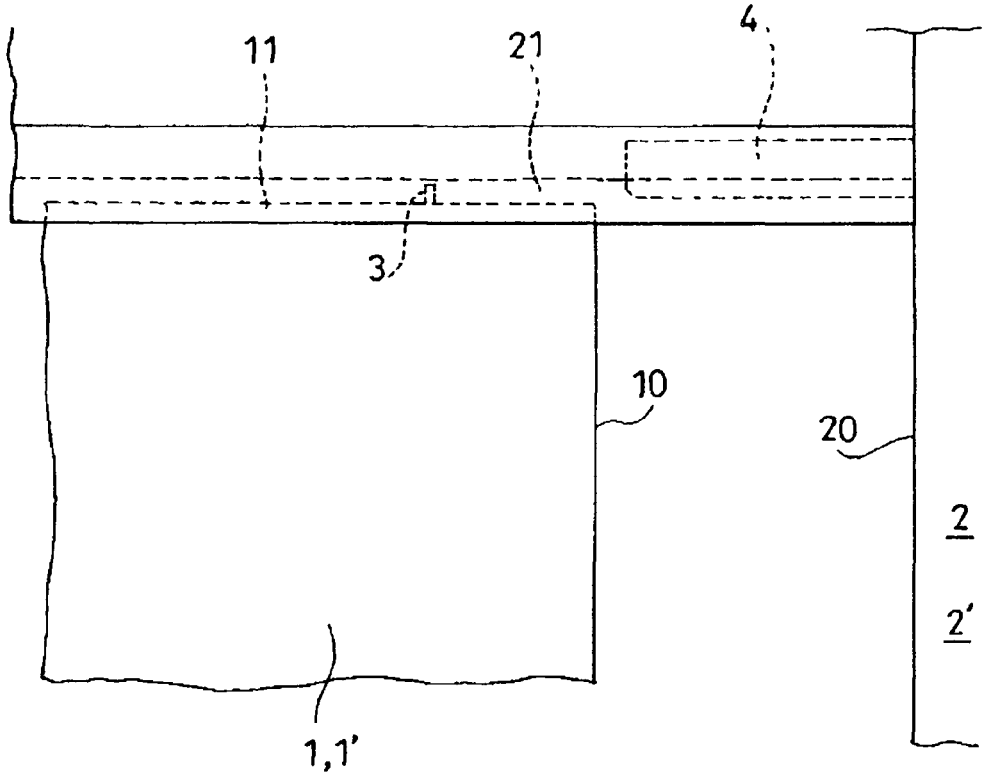
FIG. 2 is a structural view illustrating another applied example of the automatic forward movement mechanism.

Incidentally, FIG. 1 illustrates an example wherein a second connecting member 4 (latch unit 4') is provided on a movable member 1 side, and FIG. 2 illustrates an example wherein a first connecting member 3 (striker member 3') is provided on the movable member 1 side, respectively.

Figure 3:
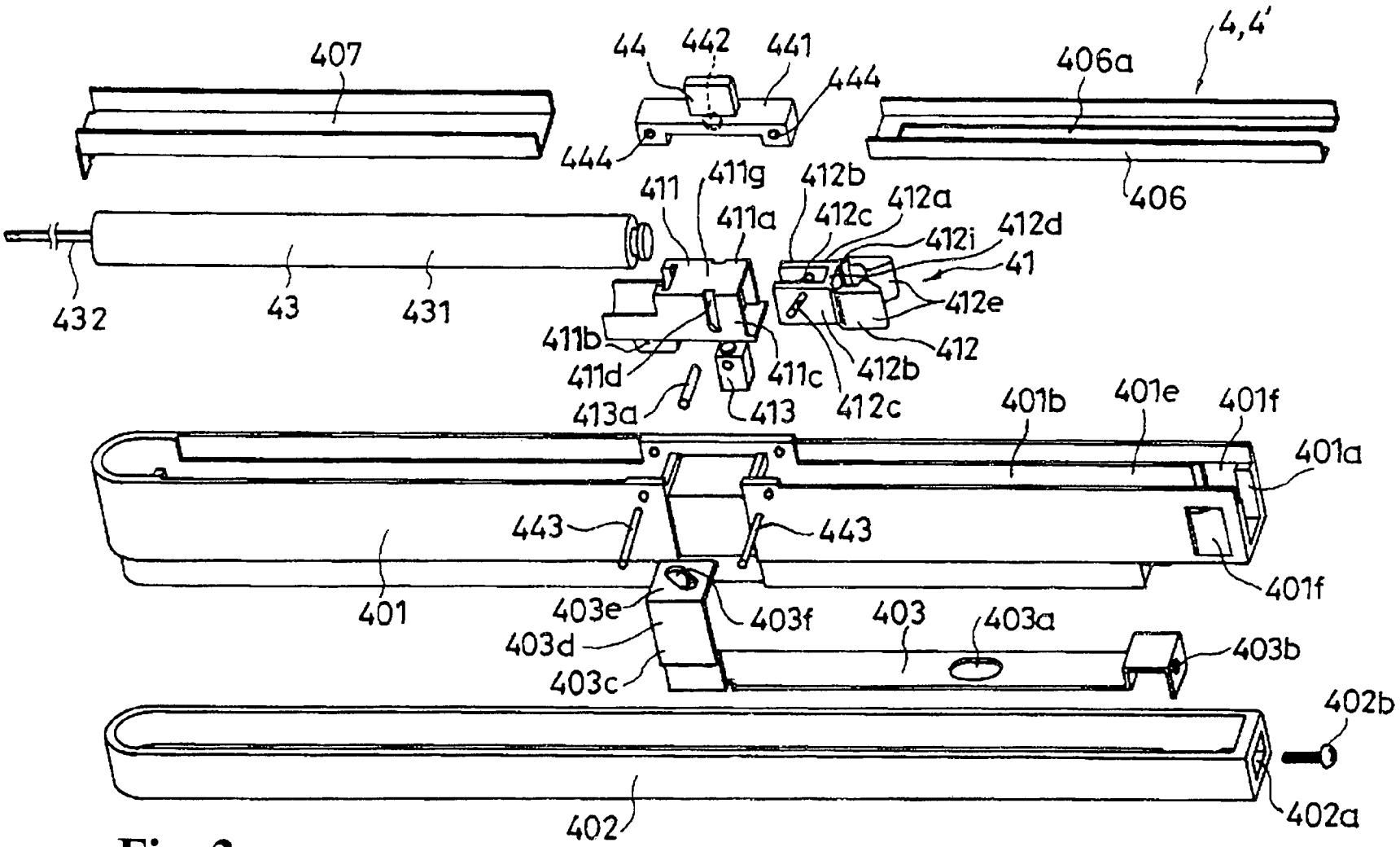
FIG. 3 is an exploded perspective structural view of a latch unit 4'.
Figure 4:
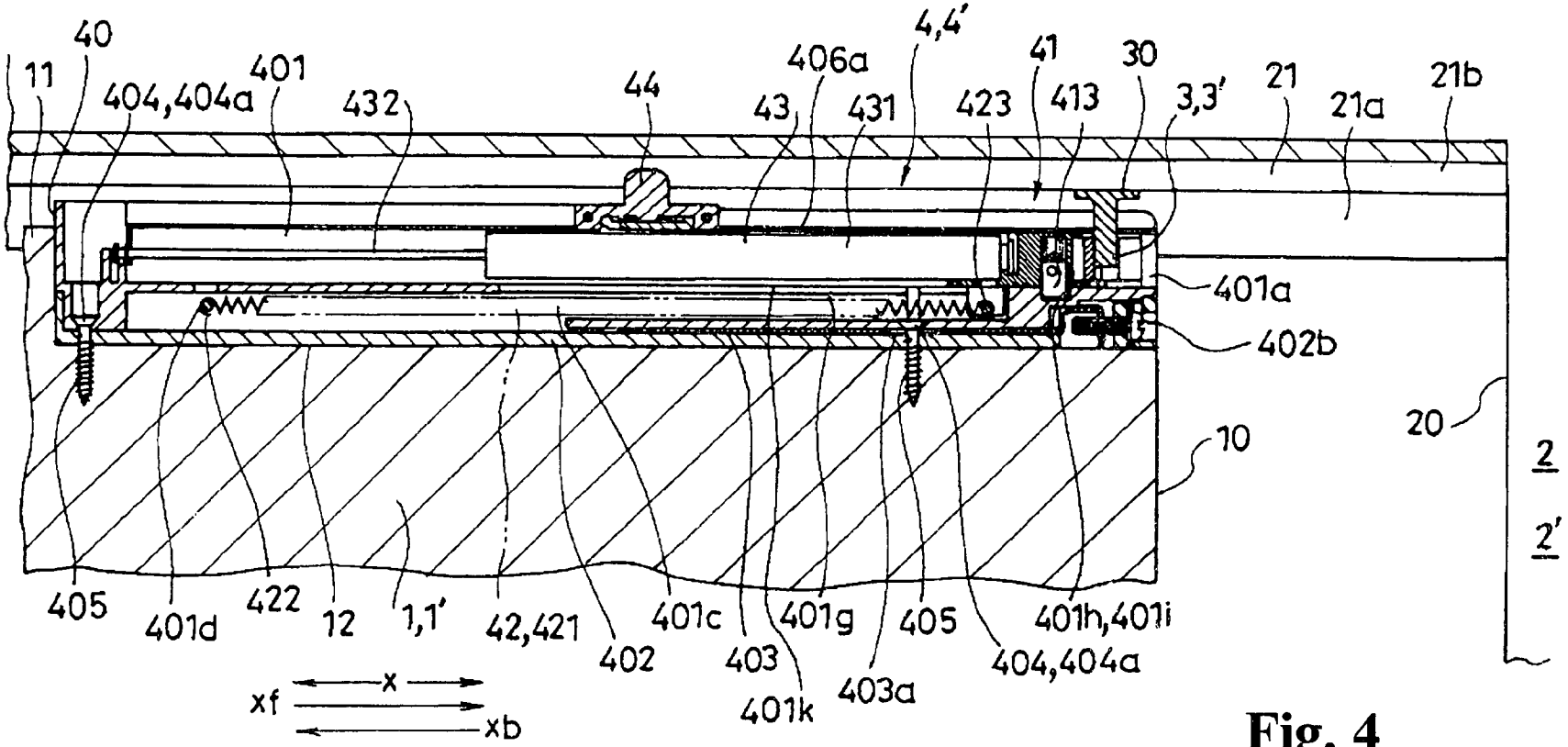
FIG. 4 is a sectional view illustrating the applied example of the automatic forward movement mechanism.
Figure 5:
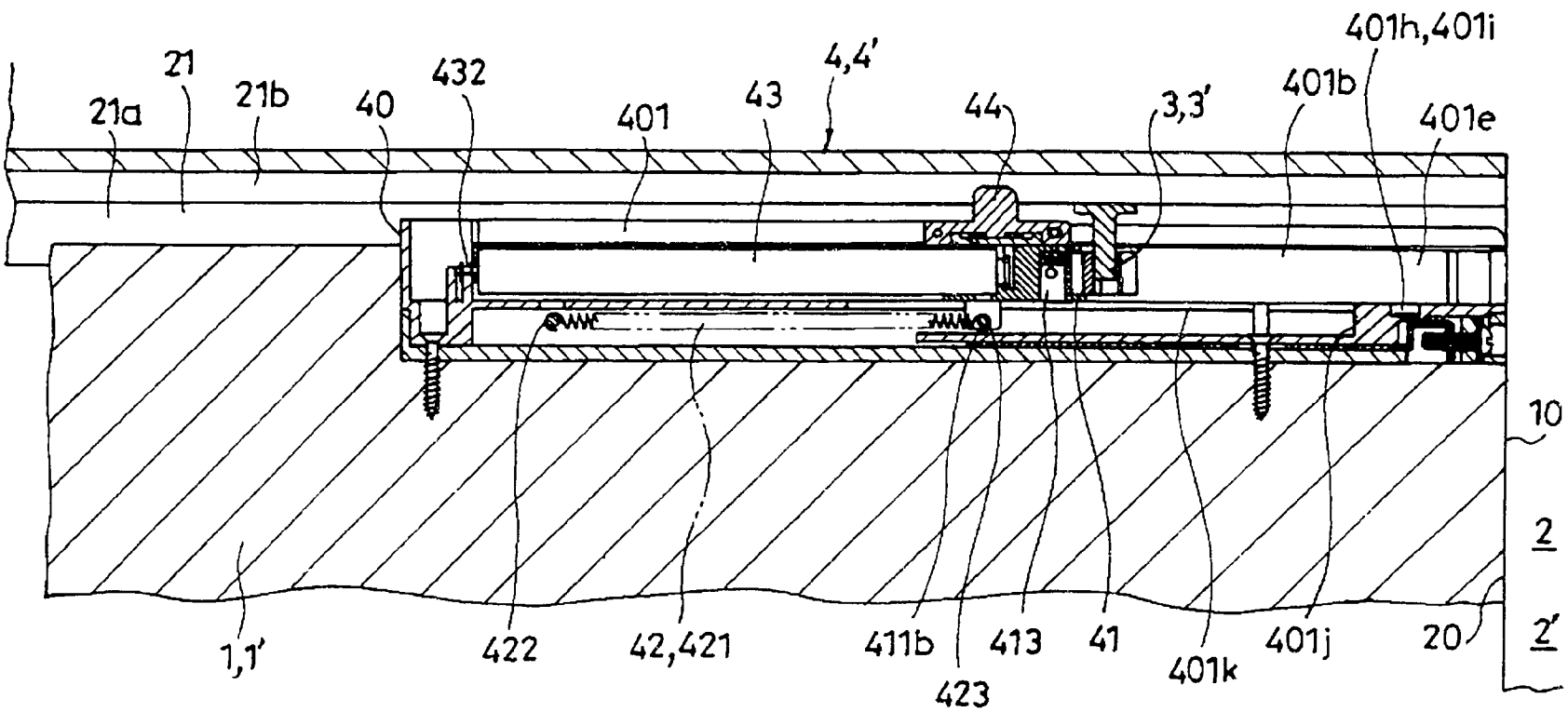
FIG. 5 is a sectional view illustrating the applied example of the automatic forward movement mechanism.
Figure 6:
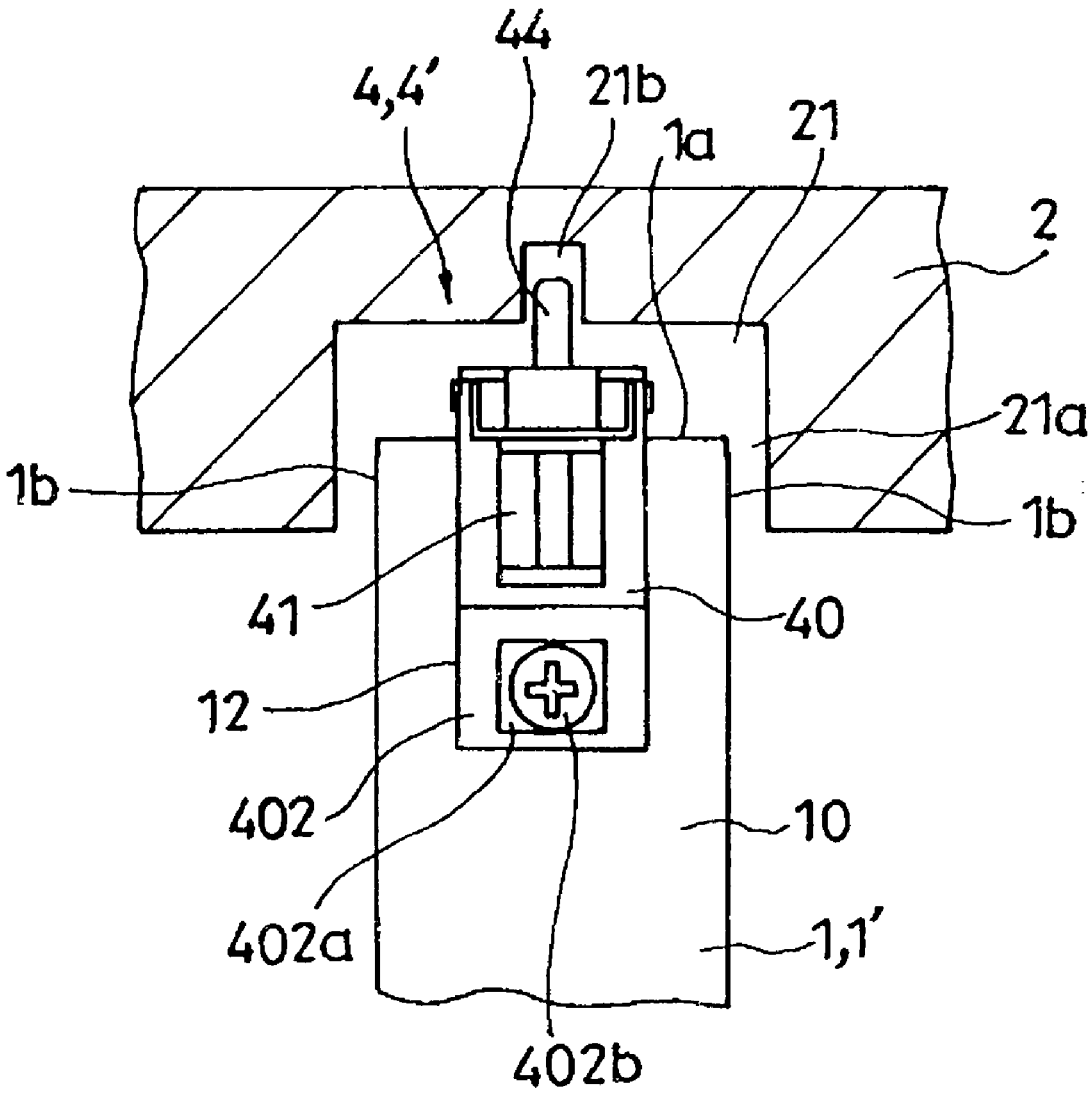
FIG. 6 is a right side view of essential parts of a movable member 1.
Figure 7:
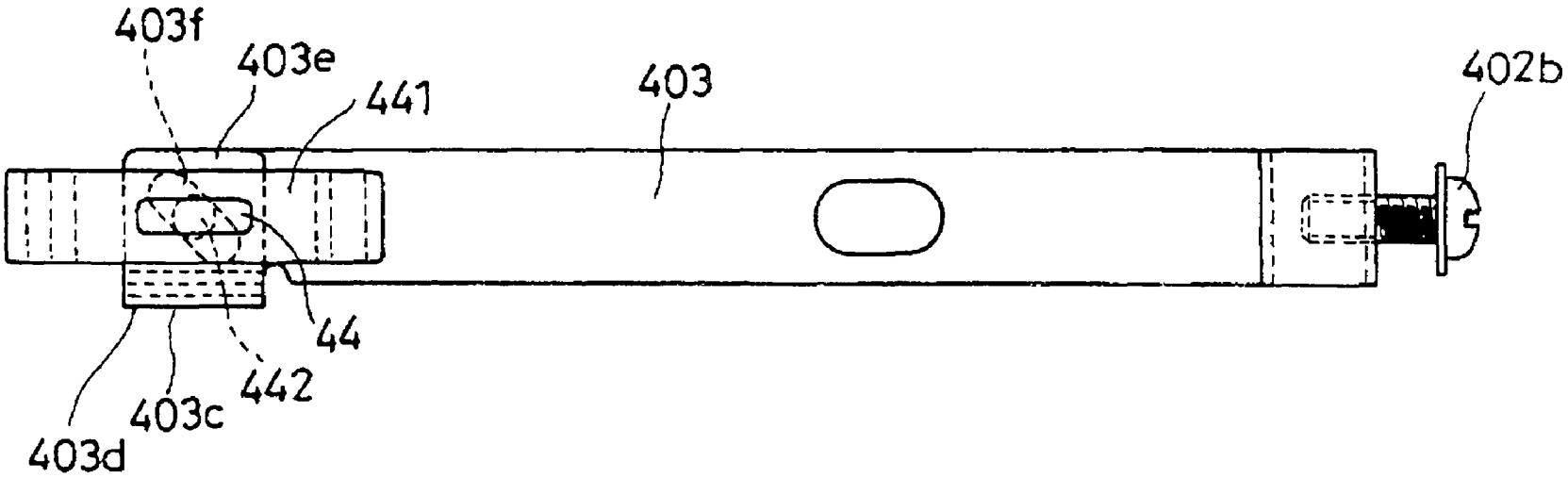
FIG. 7 is a plan view of the essential parts of the latch unit 4'.

Also, FIGS. 3-18 respectively illustrate concrete structural examples when the latch unit 4' is provided on the movable member 1 side. More specifically, FIG. 3 illustrates a state wherein each member constituting the latch unit 4' is separated; FIG. 4 shows a sectional view of essential parts when the movable member 1 is in a predetermined position; FIG. 5 shows a sectional view of essential parts when the movable member 1 is in a stopped position; FIG. 6 illustrates a state wherein the movable member 1 is seen from the front side of the movable member 1; and FIG. 7 shows only an operation plate 403 and adjuster piece 44 constituting the latch unit 4' in an assembled state seen from above. Also, FIGS. 8(*a*)-11(*b*) show plan views of the essential parts at each stage of the operation (FIGS. 8(*a*), 9(*a*), 10(*a*), 11(*a*)), and sectional side views (FIGS. 8(*b*), 9(*b*), 10(*b*), 11(*b*)) so as to easily understand the operation of the latch unit 4' when the movable member 1 is moved forward, and the operation goes in order of FIGS. 8(*a*)-11(*b*). Also, FIGS. 12(*a*)-15(*b*) show plan views of the essential parts at each stage of the operation (FIGS. 12(*a*), 13(*a*), 14(*a*), 15(*a*)), and sectional side views (FIGS. 12(*b*), 13(*b*), 14(*b*), 15(*b*)) so as to easily understand the operation of the latch unit 4' when the movable member 1 is moved forward, and the operation moves in order of FIGS. 12(*a*)-15(*b*).

Figure 16:
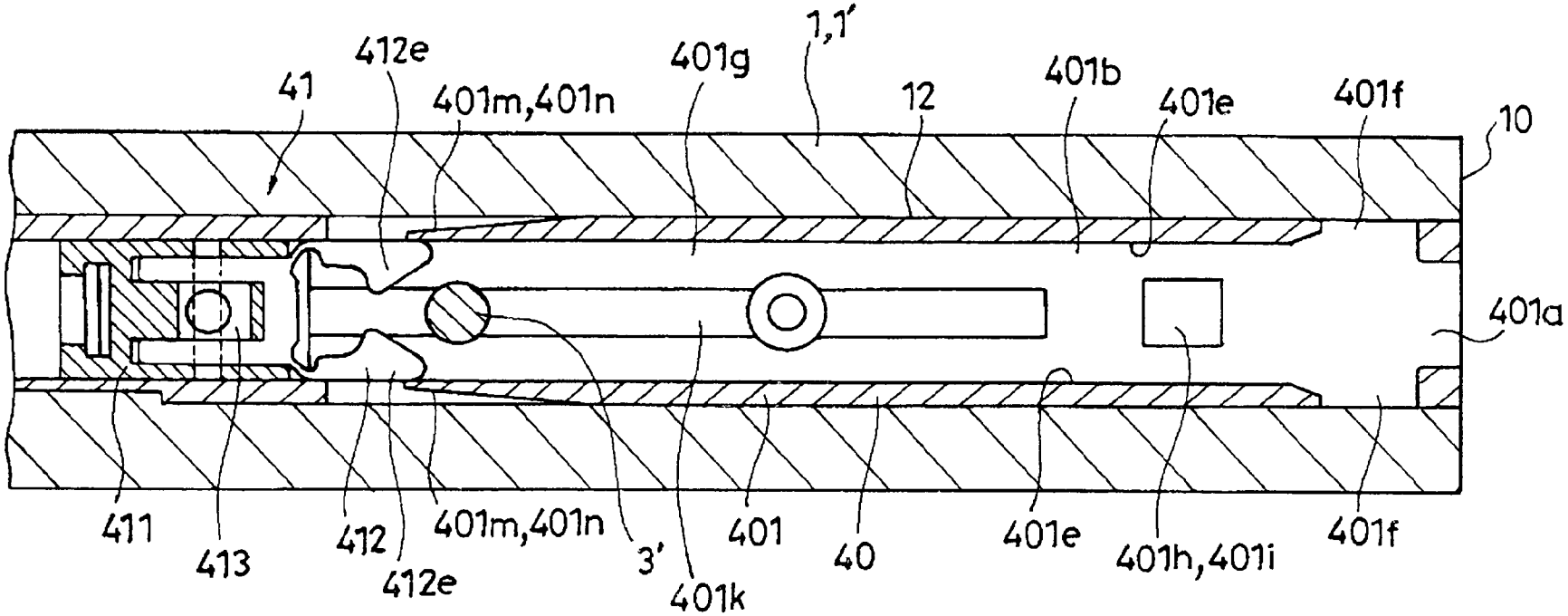
FIG. 16 is a cross sectional plan view of the essential parts illustrating a part of a process of the procedure of allowing a wrongly operated latch unit 4' to return to a regular operating state.
Figure 17:
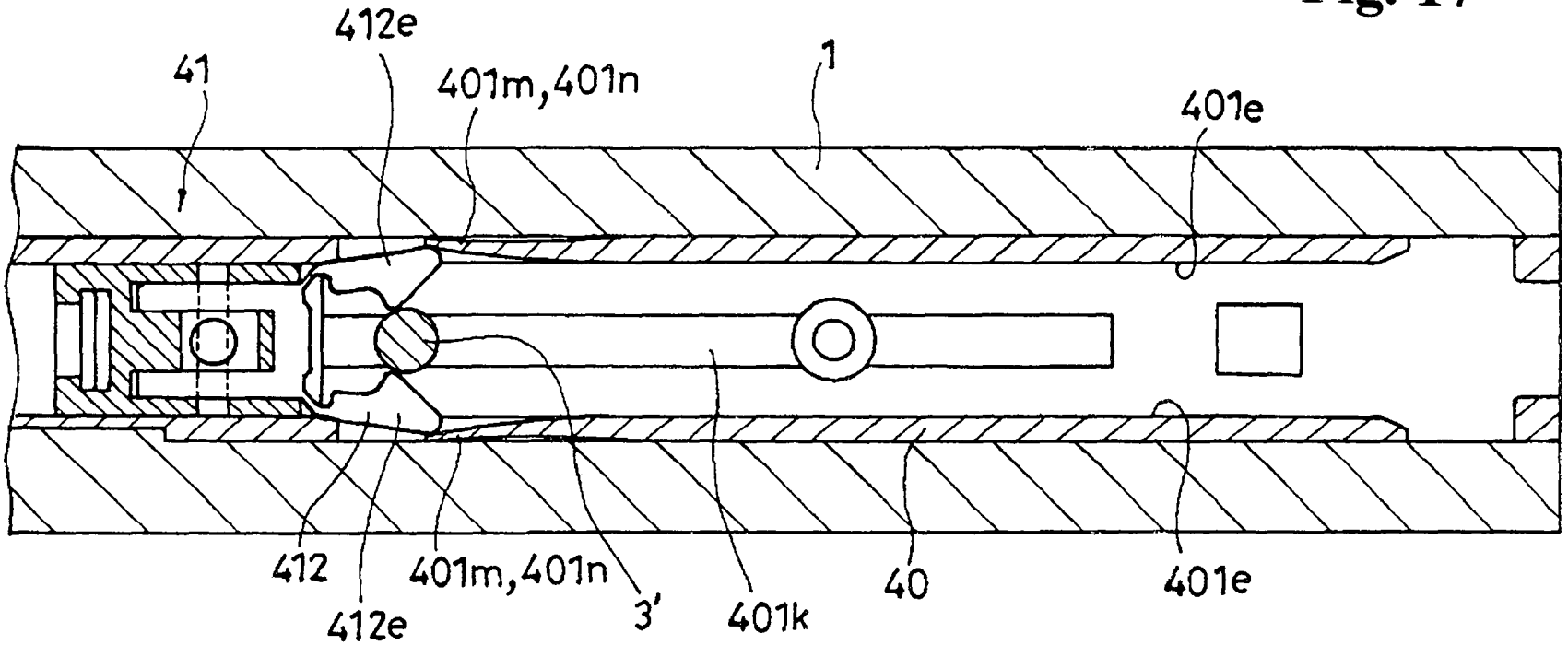
FIG. 17 is a cross sectional plan view of the essential parts illustrating the part of the process of the procedure of allowing the wrongly operated latch unit 4' to return to the regular operating state.
Figure 18:
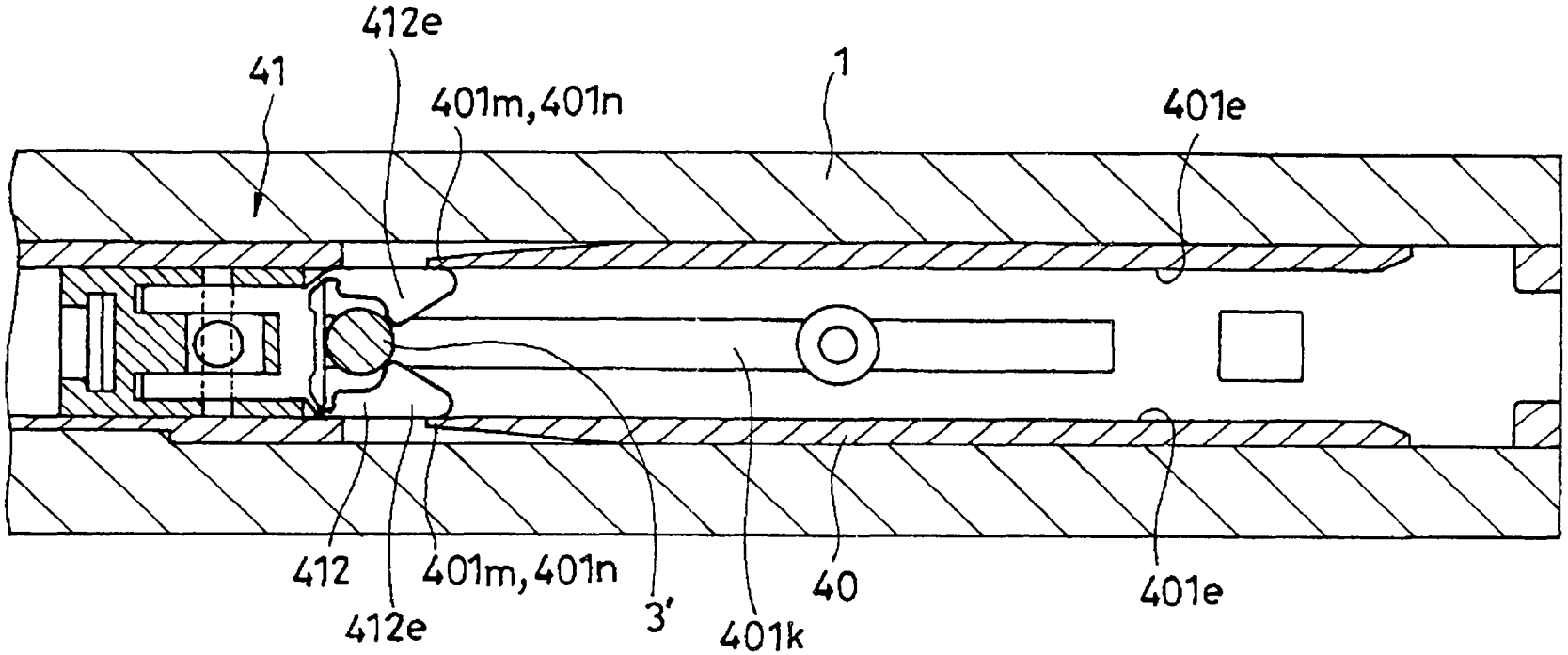
FIG. 18 is a cross sectional plan view of the essential parts illustrating the part of the process of the procedure of allowing the wrongly operated latch unit 4' to the regular operating state.

In addition, FIGS. 16-18 illustrate an example of a base 40 with a structure for returning a wrongly operated state wherein a catcher 41 was completely moved inside the base 40 in a state wherein the striker member 3' and a retaining member 412 of the catcher 41 are not engaged, to a proper operational state. In order to easily understand the returning procedure, FIGS. 16-18 show plan views of the essential parts at each stage of the procedure.

Figure 19:
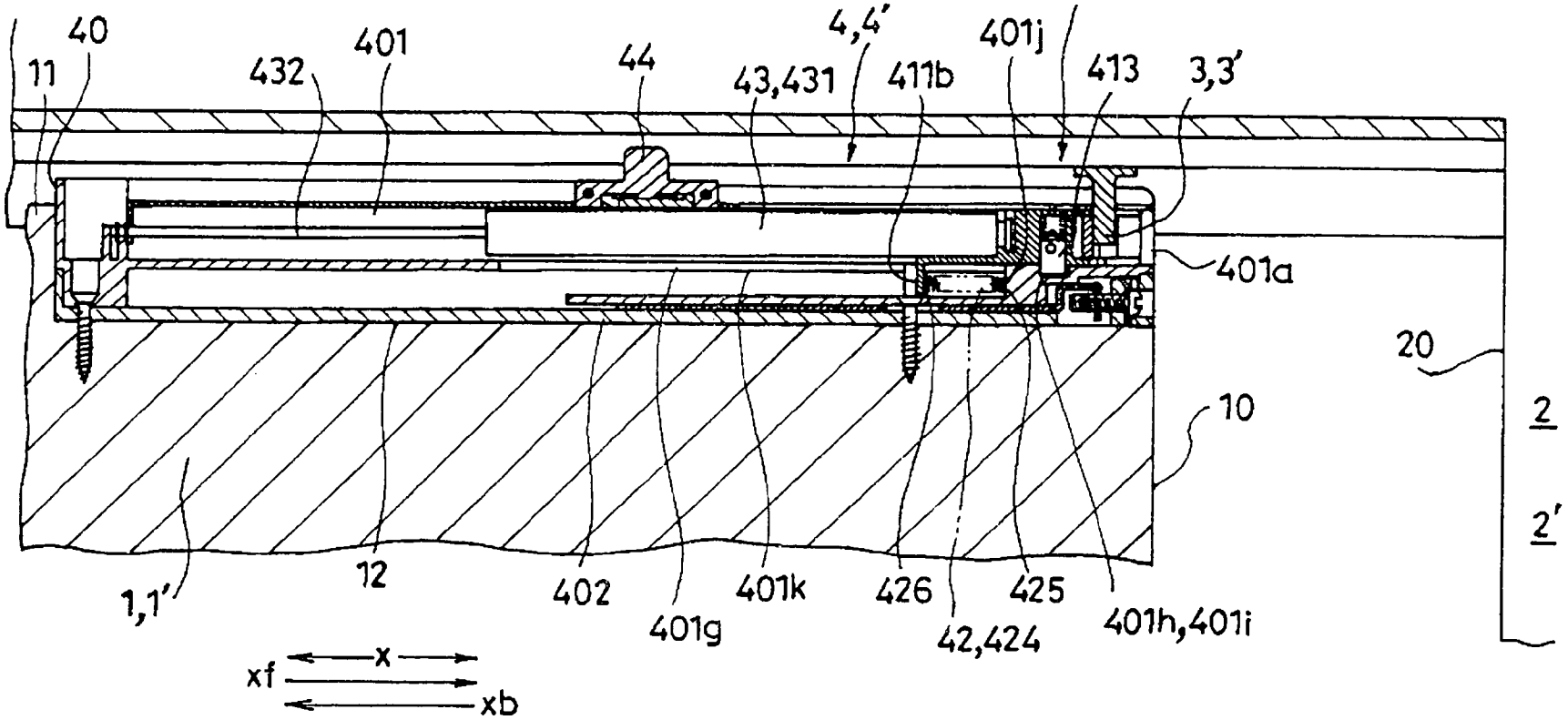
FIG. 19 is a sectional view illustrating another applied example of the automatic forward movement mechanism.
Figure 20:
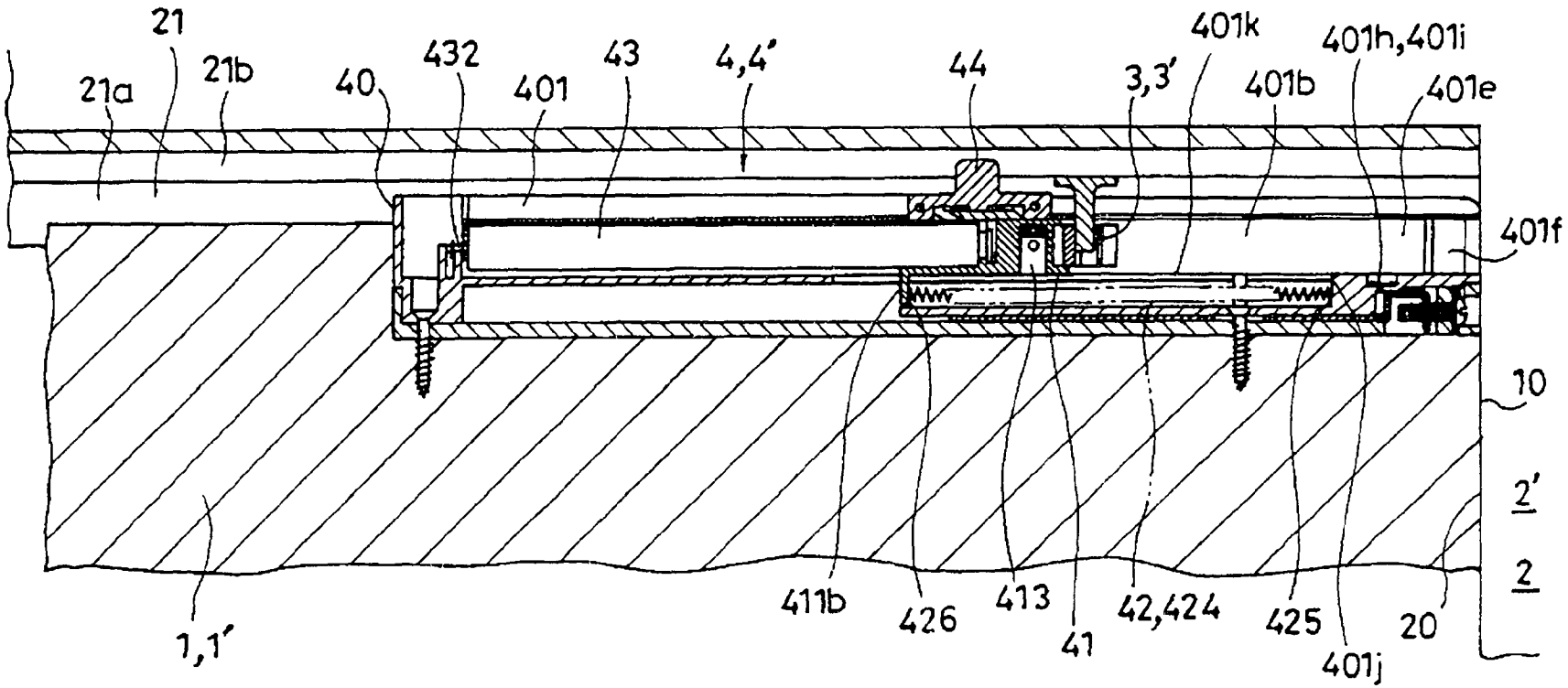
FIG. 20 is a sectional view illustrating another applied example of the automatic forward movement mechanism.

Also, FIGS. 19, 20 illustrate a structural example when a spring member 42 is a compression coil spring 424. FIG. 19 shows a cross sectional view of the essential parts when the movable member 1 is in the predetermined position, and FIG. 20 shows a cross sectional view of the essential parts when the movable member 1 is in the stopped position, respectively.

A mechanism according to the embodiment allows the movable member 1 to automatically move forward to the stopped position which was moved forward to the predetermined position.

Typically, the mechanism is used so as to allow a sliding door 1' which becomes the movable member 1 moved forward to the predetermined position (moved in a closing direction) to automatically move forward to the stopped position (closed position). Also, the mechanism is used so as to allow a drawer which becomes the movable member 1 moved forward to the predetermined position (moved in a pushed-in direction) to automatically move forward to the stopped position (housed position).

The mechanism comprises a first connecting member 3 provided in either the movable member 1 or an immovable member 2; and a second connecting member 4 provided in the other movable member 1 or immovable member 2.

A second connecting member 4 includes the catcher 41 relative to the first connecting member 3, and the catcher 41 can be moved or relatively moved along a moving direction of the movable member 1. The catcher 41 is held in a waiting position while receiving an urging force toward a forward movement direction xf or backward movement direction xb of the movable member 1.

When the movable member 1 is moved to the predetermined position, the first connecting member 3 is retained by the catcher 41 of the second connecting member 4; the retention is resolved; and the movable member 1 is automatically moved forward to the stopped position by the urging force. Also, when the movable member 1 in the stopped position is moved to the predetermined position, the catcher 41 is held in the waiting position again, and the first connecting member 3 slips through or moved from the catcher 41.

When the catcher 41 is provided in the second connecting member 4 to be able to relatively move, the retention of the catcher 41 is released by moving the movable member 1 to the predetermined position, and the second connecting member 4 can be moved in a state wherein the catcher 41 retaining the first connecting member 3 is stopped. Accordingly, the movable member 1 can be automatically moved forward to the stopped position. When the movable member 1 in the stopped position is moved backward and reaches the predetermined position again, the catcher 41 is held in the waiting position again while receiving the urging force, and the first connecting member 3 slips through the catcher 41. Accordingly, the movable member 1 is never prevented from moving backward.

When the catcher 41 is movably provided in the second connecting member 4, the retention of the catcher 41 is released by moving the movable member 1 to the predetermined position, and the catcher 41 can travel in a state wherein the first connecting member 3 is retained. Accordingly, the movable member 1 can be automatically moved forward to the stopped position. When the movable member 1 in the stopped position is moved backward and reaches the predetermined position again, the catcher 41 is held in the waiting position again while receiving the urging force. Also, since the catcher 41 slips through the first connecting member 3, the movable member 1 is never prevented from moving backward.

More specifically, the mechanism comprises the striker member 3' functioning as the first connecting member 3 which is provided in either the movable member 1 or immovable member 2; and the latch unit 4' functioning as the second connecting member 4 which is provided in the other movable member 1 or immovable member 2.

FIGS. 1, 2 illustrate examples applying the above-mentioned mechanism to the mechanism of the sliding door 1' closing an opening 2' (a portion surrounding an opening) of a building and the like. In these examples, when the sliding door 1' is moved forward to the predetermined position, for example, to the position wherein the distance between a front end 10 of the sliding door 1' and a door stop portion 20 of the opening 2' is approximately 8 cm, the sliding door 1' is automatically moved after that and moved forward to the stopped position of the sliding door 1', i.e., the closed position wherein the front end 10 of the sliding door 1' hits the door stop portion 20. Accordingly, even if the force acted on the sliding door 1' during the closing operation of the sliding door 1' is small, as long as the sliding door 1' is moved forward to the predetermined position, the sliding door 1' can be moved to the stopped position. Also, even if the force acted on the sliding door 1' during the closing operation of the sliding door 1' is too large, the sliding door 1' can be controlled not to bounce and move backward.

When the striker member 3' is provided in the immovable member 2, the catcher 41 is housed in the base 40 described later of the latch unit 4' provided in the movable member 1 to be relatively moved. In the example of FIG. 1, the latch unit 4' is provided in the upper end part of the front end 10 side of the sliding door 1'. The bar-like striker member 3' is attached to the opening 2' side in such a way as to project downwardly from the bottom of an upper groove 21 of the opening 2' wherein an upper end part 11 of the sliding door 1' is housed. The striker member 3' enters the base 40 in the predetermined position by the forward movement of the sliding door 1', and retained by the catcher 41.

When the striker member is provided in the movable member, the catcher 41 is housed in the base 40 described later of the latch unit 4' provided in the immovable member 2 so as to be movable. In the example of FIG. 2, the striker member 3' is provided in the upper end part 11 of the front end 10 side of the sliding door 1' and projects upwardly. Also, the latch unit 4' is provided on the door stop portion 20 side of the upper part of the opening 2', and allows an internal space 401*b* of the base 40 to communicate with the upper groove 21 of the opening 2' wherein the upper end part 11 of the sliding door 1' is housed. Due to the forward movement of the sliding door 1', the striker member 3' enters the base 40 in the predetermined position, and retained by the catcher 41.

FIGS. 3-18 illustrate examples wherein the striker member 3' is provided on the immovable member 2 (more specifically, the opening 2') side, and the latch unit 4' is provided on the movable member 1 (more specifically, the sliding door 1') side. The sliding door 1' is housed in such a way that an end part 1*a* along the moving direction of the sliding door 1', in this case, the upper end part 11, is housed in the groove 21 (a wide groove 21*a* described later) which is formed in the upper part of the opening 2' and whose opening faces downward. The front end 10 is moved forward to the stopped position wherein the front end 10 hits the door stop portion 20. In this stopped position, the opening of the opening 2' is closed. Also the sliding door 1' is moved backward from the stopped position, so that the opening of the opening 2' is open.

(Striker Member 3')

In the example, the striker member 3' is formed as a round bar member whose upper end is integrally connected to the lower part of an attachment portion 30 to the bottom of the wide groove 21*a*.

(Latch Unit 4')

Also, the latch unit 4' includes:

(1) base 40;

(2) catcher 41; and (3) spring member 42.

(Latch Unit 4'/Base 40)

The base 40 includes the internal space 401*b* housing the catcher 41 so as to relatively move the catcher 41 along the moving direction of the movable member 1; a fixing portion 404 to the movable member 1; and a fixing portion 401*d* of a spring end 422 of the spring member 42.

In the example shown in the figures, the base 40 includes:

(1) a base main body 401 whose upper surface and a front end 401*a* is open, and which is long in a moving direction x of the movable member 1;

(2) a mount base 402 assembled to the base main body 401 in such a way that the lower part of the base main body 401 is housed inside; and (3) the operation plate 403 of an adjuster piece 44 which is housed between the lower part of the base main body 401 and the upper surface of the mount base 402 so as to be movable back and forth.

The inside of the base main body 401 functions as the internal space 401*b*. In the example in the figures, the base main body 401 is constituted in such a way that upper and lower plate members have a space until the approximately middle position of the length direction from the front end. Accordingly, an opening 401*c* is formed in the approximately middle position of the length direction of the base main body 401, and opens to the back end side of the base main body 401. The spring member 42 is constituted by a tension coil spring 421 in the example of the figures. The tension coil spring 421 is fixed to a slide base 411 of the catcher 41 whose other spring end 423 is housed inside the base main body 401. The tension coil spring 421 passes through the opening 401*c*, and is pulled out to the lower part of the base main body 401, and the spring end 422 is fastened to the fixing portion 401*d* formed in the back end of the base main body 401.

In the example in the figures, the upper end part 11 of the sliding door 1' which becomes the movable member 1 includes a hole opening. An attachment hole 12 is formed in such a way as to be open even in the front end 10 of the sliding door 1', and the base 40 enters the attachment hole 12 with the mount base 402 side down. Through a through-hole 404*a* for a screw 405 which passes through the lower part of the base main body 401 and mount base 402, the screw 405 is fastened to the bottom of the attachment hole 12 from the inside of the base main body 401, so that the base 40 is attached to the sliding door 1'. More specifically, in the example in the figures, the through-hole 404*a* functions as the fixing portion 404. In the example in the figures, the screw 405 fastened to the front end 10 side of the sliding door 1' passes through an elongate hole 403*a* which is long in the back and forth directions and formed in the operation plate 403 so as not to interfere the back and forth movement of the operation plate 403.

Also, in the example of the figures, window holes 401*f* for projections of retaining pieces 412*e* of the retaining member 412 of the catchers 41 described later are formed respectively in both side walls 401*e*, 401*e* of the base main body 401 which is located on the front end 401*a* side of the base main body 401. Also, an engagement depression 401*i* which becomes an engagement portion 401*h* of a lock member 413 of the catcher 41 described later is formed in a bottom wall 401*g* of the base main body 401, in a position which is the backside of the window holes 401*f* of the base main body 401 and adjacent to the window holes 401*f*. Also, a cleavage groove 401*k* whose width is narrower than the engagement depression 401*i* to prevent the lock member 413 from entering, is formed in an upper plate member whose upper surface is the bottom wall 401*g*, from the engagement depression 401*i* to about a middle position in the longitudinal direction of the base main body 401. A fixing portion 411*b* of the slide base 411 of the catcher 41 described later enters between the upper plate member and lower plate member through the cleavage groove 401*k*. The other spring end 423 of the tension coil spring 421 is fastened to the fixing portion 411*b* which is entered as described above. Also, a step surface 401*j* facing backward is formed between the upper and lower plate members immediately behind the engagement depression 401*i*.

In addition, in the example of the figures, a shaft portion of an adjustment screw 402*b* which is entered into a through-hole 402*a* formed in the front end of the mount base 402 is fastened by a screw to a screw hole 403*b* formed in the front end of the operation plate 403. By rotating the adjustment screw 402*b*, the operation plate 403 can move back and forth. On the back end side of the operation plate 403, there is formed a linkage portion 403*c* including a rising plate 403*d* extending upward through the outside surface of the approximately middle position of the length direction of the base main body 401; and a side plate 403*e* extending sideways from the upper end of the rising plate 403*d* and positioned on the upper side of the base main body 401. The adjuster piece 44 described later moves in a direction perpendicular to the moving direction x of the movable member 1 by a cam groove 403*f* formed in the side plate 403*e* of the linkage portion 403*c*.

The striker member 3' enters into the internal space 401*b* from the open front end 401*a* of the base main body 401 by moving the movable member 1 forward up to the predetermined position. Also, the striker member 3' entered as described above slips through the front end 401*a* of the base main body 401 by the backward movement of the movable member 1.

(Latch Unit 4'/Catcher 41)

Also, the catcher 41 includes:

(1) slide base 411;

(2) retaining member 412 of the striker member 3'; and (3) lock member 413.

The slide base 411 includes first guide grooves 411*d*; and the fixing portion 411*b* of the other spring end 423 of the spring member 42.

In the example of the figures, in the slide base 411, the front end part is an assembled portion 411*a* to the retaining member 412, and the lower surface of the back end part has the fixing portion 411*b*. On the front side of the internal space 401*b* of the base 40 which is closed by a front upper lid 406 with a through-groove 406*a* for the striker member 3', the slide base 411 is guided to the inner wall of the internal space 401*b*, and relatively moved along the moving direction x of the movable member 1.

The front end part of the slide base 411 includes right and left side plates 411*c*, 411*c*; a middle block 411*e* formed between the right and left side plates 411*c*, 411*c*; and a top plate 411*g* extending on the upper end of the right and left plates 411*c*, 411*c* and middle block 411*e*. The front end of the slide base 411 is open in front. Housing spaces 411*f* for the lock member 413 which are open downward and toward both right and left sides are formed in the middle block 411*e*. Also, the first guide grooves 411*d* are formed respectively adjacent to the housing spaces 411*f* of the right and left side plates 411*c*, 411*c*. In the example of the figures, the first guide grooves 411*d* are constituted in such a way as to form through holes extending in a vertical direction.

Also, the back end side of the retaining member 412 is an assembled portion 412*a* to the slide base 411, and includes second guide grooves 412*c* diagonally intersecting the first guide grooves 411*d*. The front end side of the retaining member 412 includes the retaining pieces 412*e* always projecting outwardly and urged in a non-retention position.

In the example of the figures, the retaining member 412 includes the retaining pieces 412*e* in front of an intermediate part 412*d*; and the assembled portion 412*a* at the back.

The assembled portion 412*a* is constituted by a right-and-left pair of leg pieces 412*b*, 412*b*. In the retaining member 412, one of the leg pieces 412*b* is inserted between one of the side plates 411*c* of the slide base 411 and the middle block 411*e* from the front; and the other of the leg pieces 412*b* is inserted between the other of the side plates 411*c* of the slide base 411 and the middle block 411*e* from the front. Accordingly, the retaining member 412 is assembled to the slide base 411.

In the example of the figures, the second guide grooves 412*c* are formed respectively in the right-and-left pair of leg pieces 412*b*, 412*b*. In the example of the figures, the second guide grooves 412*c* are constituted in such a way as to form the through holes which are gradually inclined obliquely upward toward the front.

Also, in the example of the figures, the retaining pieces 412*e* are formed respectively on the right and left of the retaining member 412. The back ends of both retaining pieces 412*e* are integrally connected to the intermediate part 412*d* through thin-walled resin hinge portions 412*i*. The retaining pieces 412*e* are constituted in such a way as to rotate front ends 412*f* thereof to right and left centering on the hinge portions 412*i*. Also, both retaining pieces 412*e* include elevated portions 412*g* in the inner faces of the front ends 412*f* sides. The faces facing the backward of the elevated portions 412*g* function as engagement faces 412*h* for the striker member 3'. The pair of retaining pieces 412*e*, 412*e* are positioned in the non-retention position which has an approximately equal space to the external diameter of the striker member 3' between top portions of the elevated portions 412*g* when the front ends 412*f* of the retaining pieces 412*e* do not contact the inner walls of the base 40 due to elasticity of the hinge portions 412*i*. (FIG. 8(*a*))

Also, the lock member 413 is always urged toward the engagement position being caught on the engagement portion 401*h* of the base 40 by urging means. The lock member 413 includes an interlocking shaft 413*a* which passes through the first guide grooves 411*d* and second guide grooves 412*c*.

In the example of the figures, the lock member 413 is housed in the housing spaces 411*f* formed in the middle block 411*e* of the slide base 411 so as to be movable up and down. The lower end side of the lock member 413 is always urged in such a way as to project downward from the lower part of the slide base 411 by a compression coil spring 413*b* installed between the top plate 411*g* of the slide base 411 facing the housing spaces 411*f* and the upper end of the lock member 413.

In the example of the figures, a through hole 413*d* with a circular shape extending in a horizontal direction is formed in the upper part of the lock member 413. The interlocking shaft 413*a* passes through the first guide grooves 411*d* formed in the right and left side plates 411*c*, 411*c* of the slide base 411; the second guide grooves 412*c* formed in the pair of leg pieces 412*b*, 412*b* of the retaining member 412; and the through hole 413*d*. Accordingly, the slide base 411, retaining members 412, and lock member 413 are assembled.

(Latch Unit 4'/Spring Member 42)

The tension coil spring 421 as the spring member 42 is extended most in the waiting state wherein the lock member 413 of the catcher 41 is caught on the engagement portion 401*h* of the base 40. (FIG. 4)

Figure 8A:
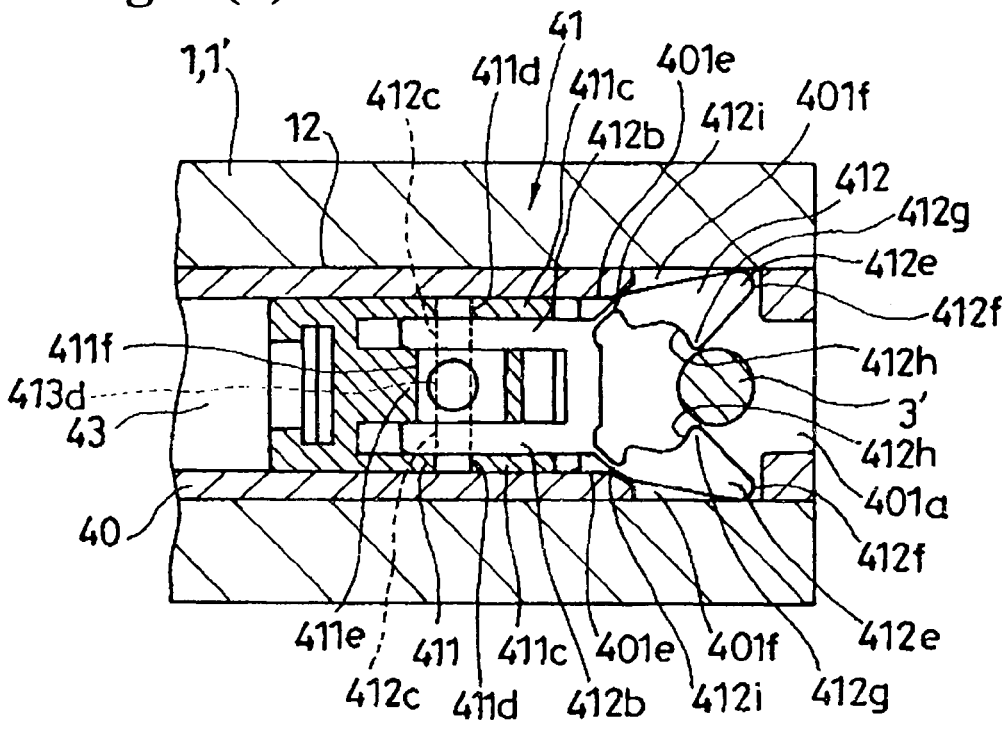
FIG. 8(*a*) is a cross sectional plan view of essential parts, and FIG. 8(*b*) is a cross sectional side view of the essential parts, illustrating a part of a process of the operation of the latch unit 4'.
Figure 8B:
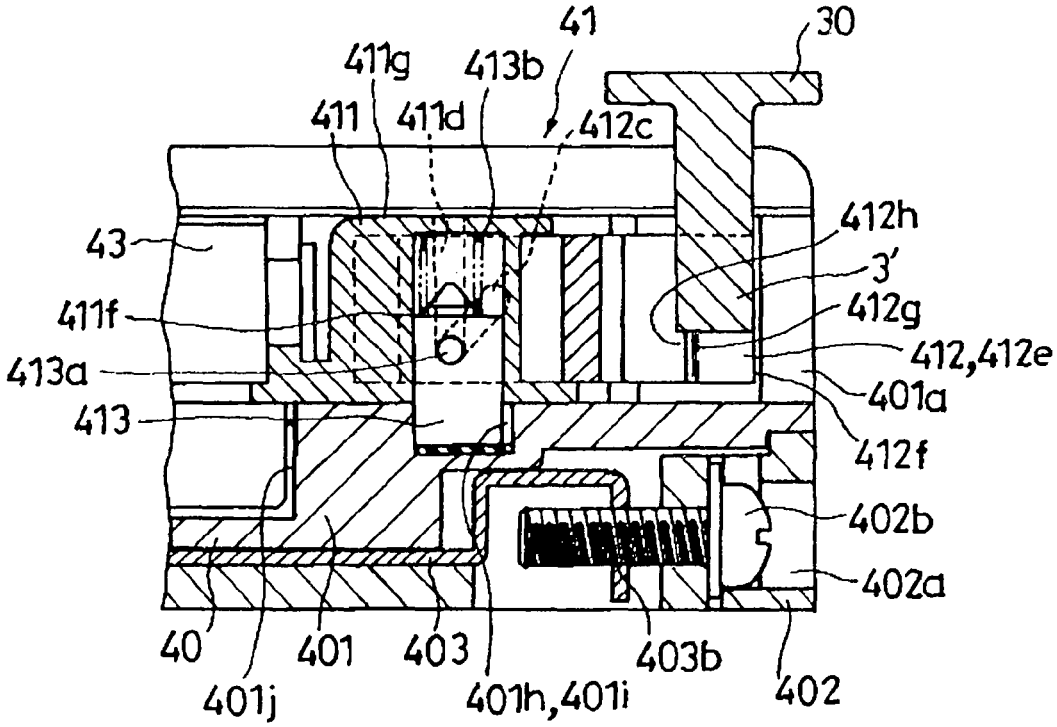

In the waiting state, the interlocking shaft 413*a* is positioned in the back ends of the second guide grooves 412*c* by the lock member 413 projecting downward due to an action of the tension coil spring 421. The retaining member 412 is positioned in a forward movement position wherein a space is provided between the rear face of the intermediate part 412*d* and the front face of the middle block 411*e* of the slide base 411. In the forward movement position, the retaining pieces 412*e* are entered into the window holes 401*f* formed in both side walls 401*e*, 401*e* of the base main body 401 constituting the base 40, respectively. The pair of retaining pieces 412*e*, 412*e* is positioned in the non-retention position. (FIG. 8)

When the movable member 1 is moved to the predetermined position from the waiting position, the striker member 3' hits the retaining member 412 of the catcher 41 which is in the waiting state, and the retaining member 412 can go back due to slopes of the second guide grooves 412*c*. In the example of the figures, the striker member 3' hits the front face of the intermediate part 412*d* of the retaining member 412. At the same time, the lock member 413 is moved to a non-engagement position against the urging force. In the example of the figures, the lock member 413 is moved upward while compressing the compression coil spring 413*b*, and the lower end of the lock member 413 slips through the engagement depression 401*i* of the base main body 401. Also, due to the backward movement of the retaining member 412, the retaining pieces 412*e* of the retaining member 412 are guided by inner walls of the base 40, i.e., side walls 401*e* of the base main body 401, and moved in the retention position, thereby engaging the striker member 3'. In the example of the figures, due to the backward movement of the retaining member 412, the retaining pieces 412*e* slip through the window holes 401*f*, and are rotated inwardly while elastically transforming the hinge portions 412*i* by inner walls behind the window holes 401*f*. Due to these rotations, the space between the top portions of the elevated portions 412*g* of the pair of retaining pieces 412*e* becomes smaller than the external diameter of the striker member 3' which is entered behind the elevated portions 412*g* of the pair of retaining pieces 412*e*.

(Function)

Figure 9A:
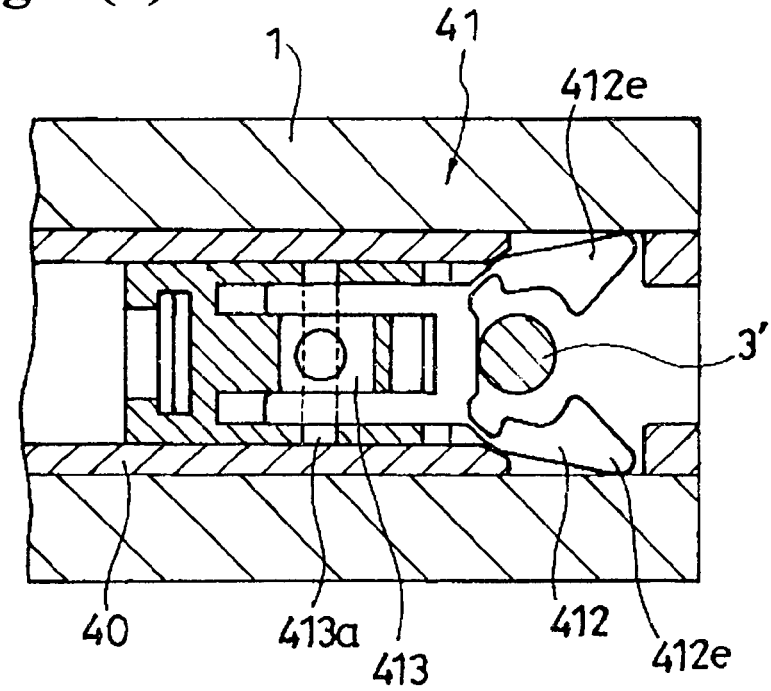
FIG. 9(*a*) is a cross sectional plan view of the essential parts, and FIG. 9(*b*) is a cross sectional side view of the essential parts, illustrating the part of the process of the operation of the latch unit 4'.
Figure 9B:
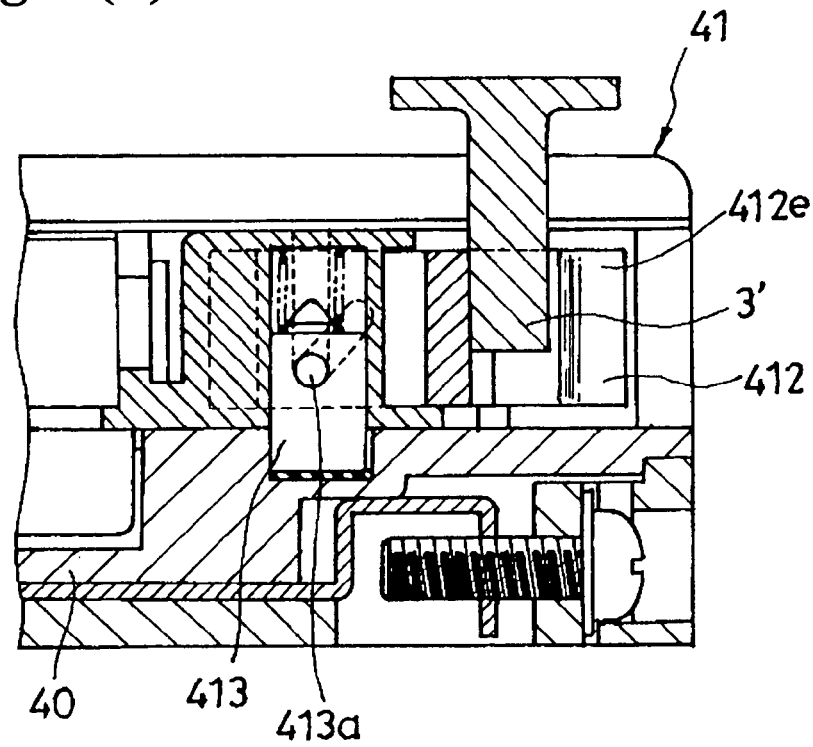
Figure 10A:
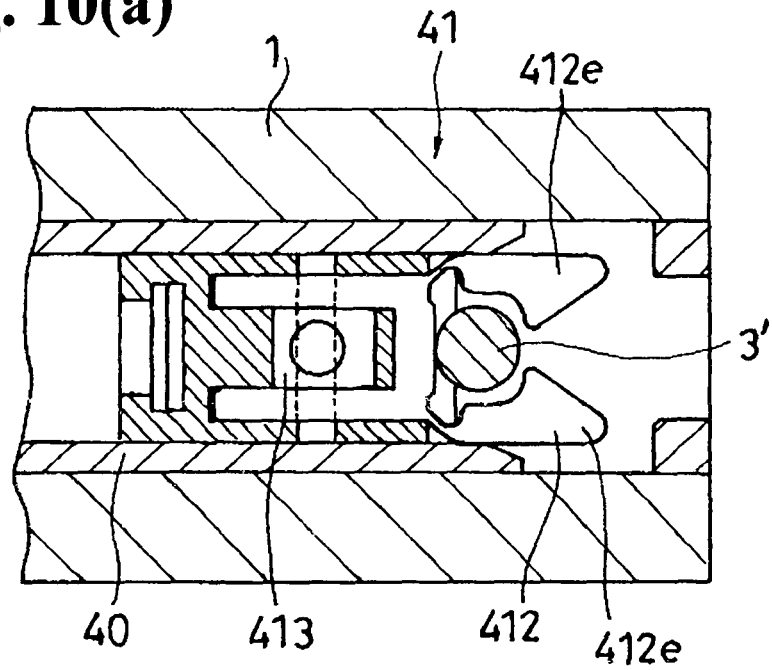
FIG. 10(*a*) is a cross sectional plan view of the essential parts, and FIG. 10(*b*) is a cross sectional side view of the essential parts, illustrating the part of the process of the operation of the latch unit 4'.
Figure 10B:
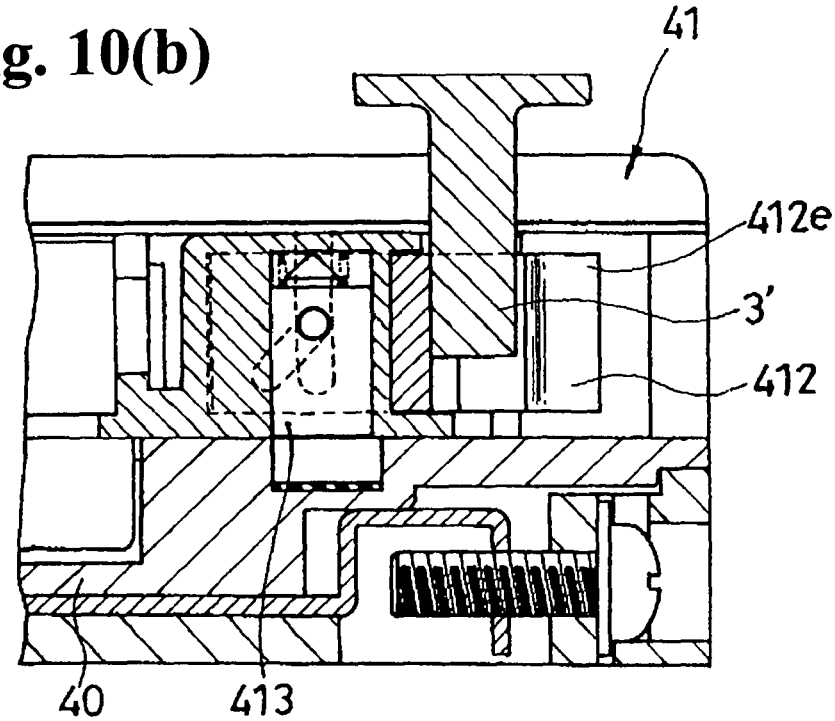
Figure 11A:
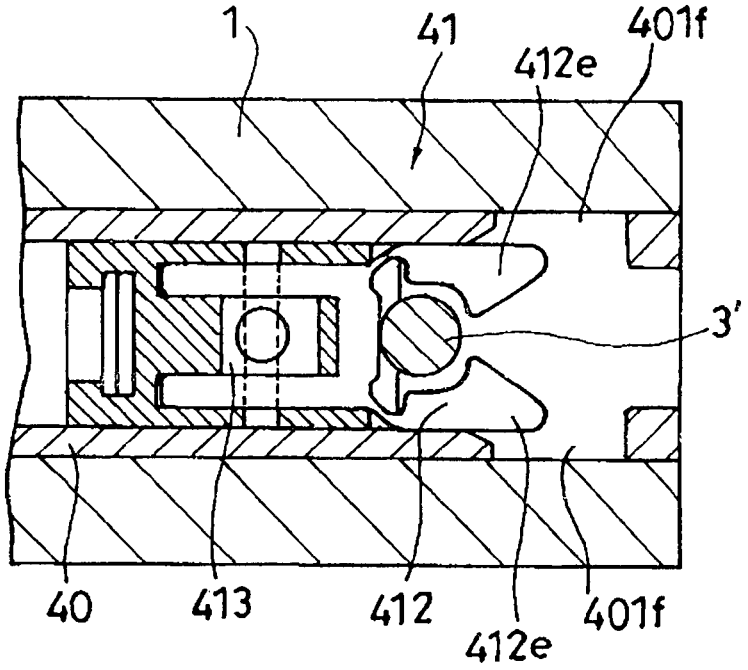
FIG. 11(*a*) is a cross sectional plan view of the essential parts, and FIG. 11(*b*) is a cross sectional side view of the essential parts, illustrating the part of the process of the operation of the latch unit 4'.
Figure 11B:
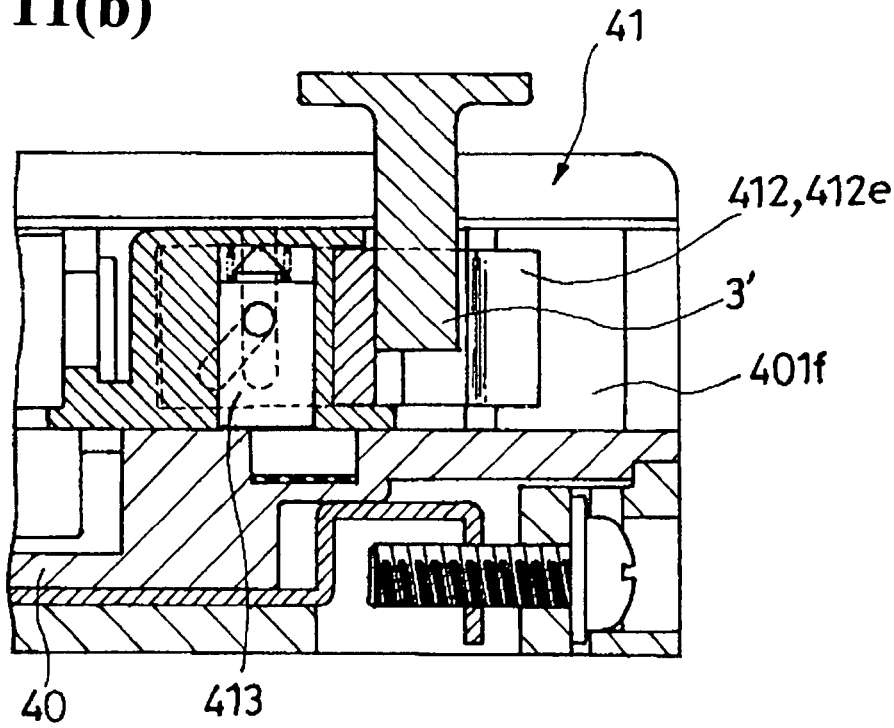
Figure 12A:
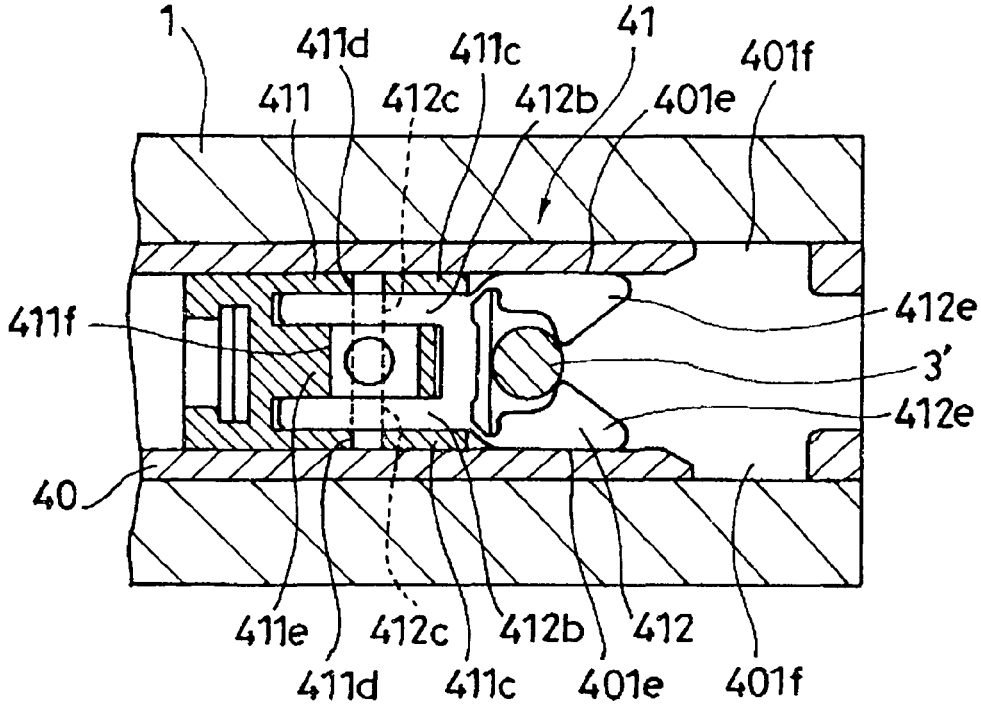
FIG. 12(*a*) is a cross sectional plan view of the essential parts, and FIG. 12(*b*) is a cross sectional side view of the essential parts, illustrating the part of the process of the operation of the latch unit 4'.
Figure 12B:
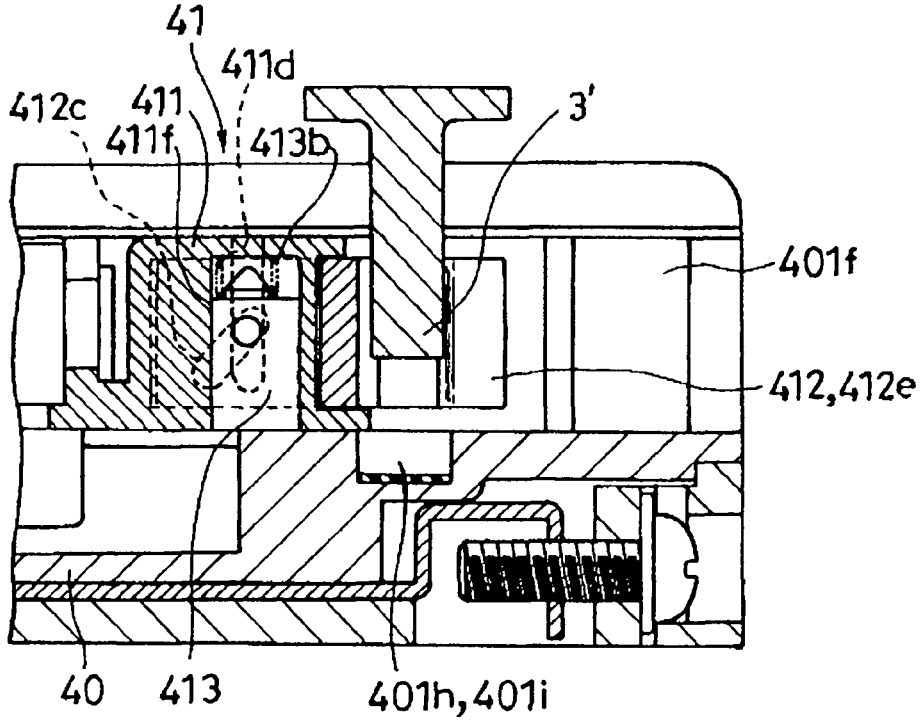
Figure 13A:
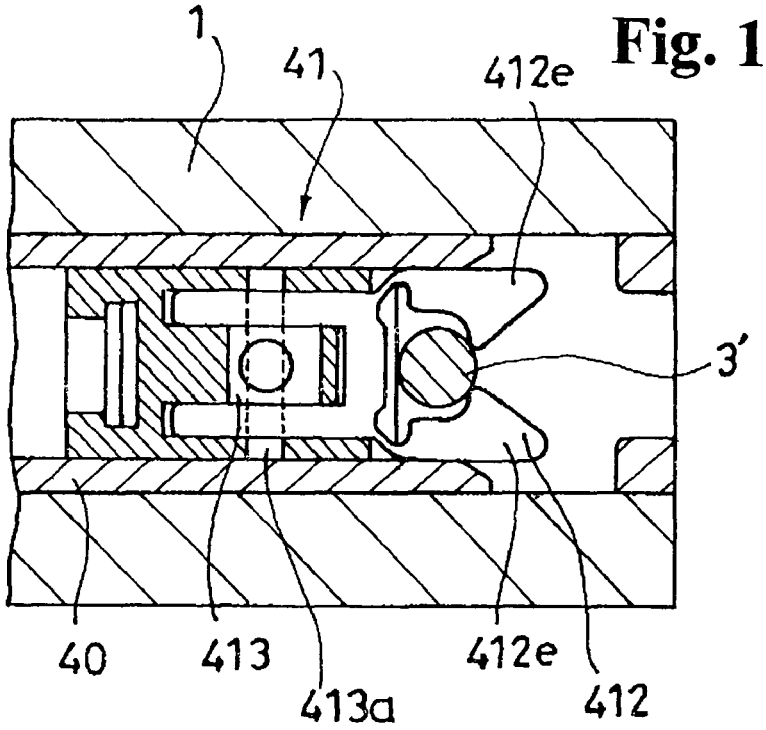
FIG. 13(*a*) is a cross sectional plan view of the essential parts, and FIG. 13(*b*) is a cross sectional side view of the essential parts, illustrating the part of the process of the operation of the latch unit 4'.
Figure 13B:
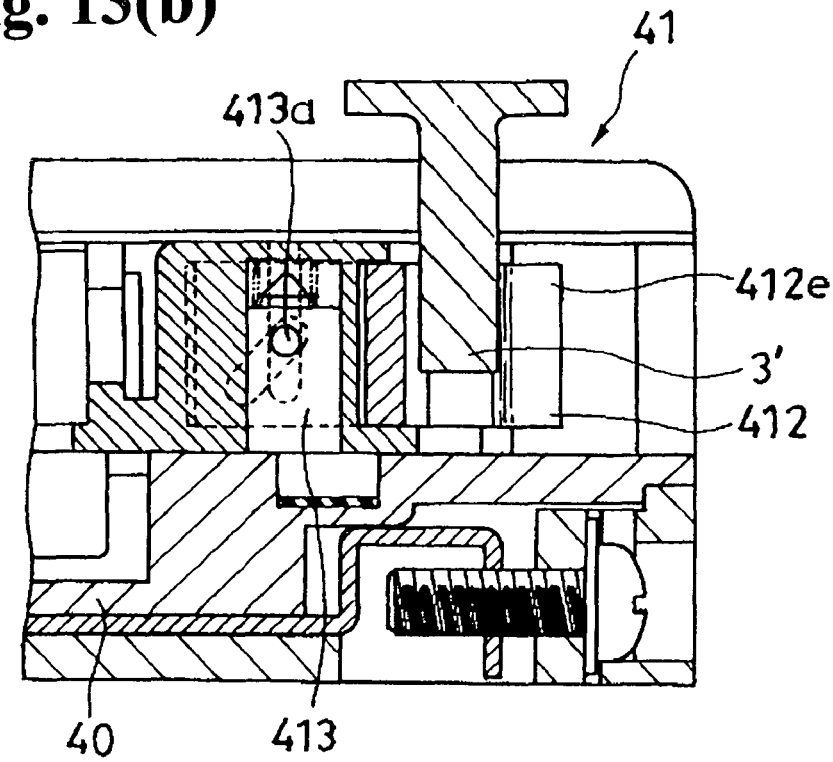
Figure 14A:
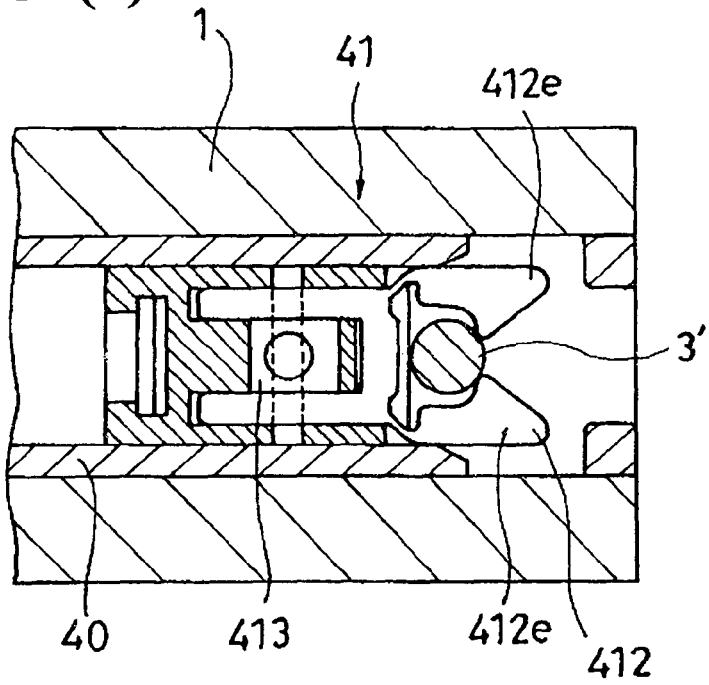
FIG. 14(*a*) is a cross sectional plan view of the essential parts, and FIG. 14(*b*) is a cross sectional side view of the essential parts, illustrating the part of the process of the operation of the latch unit 4'.
Figure 14B:
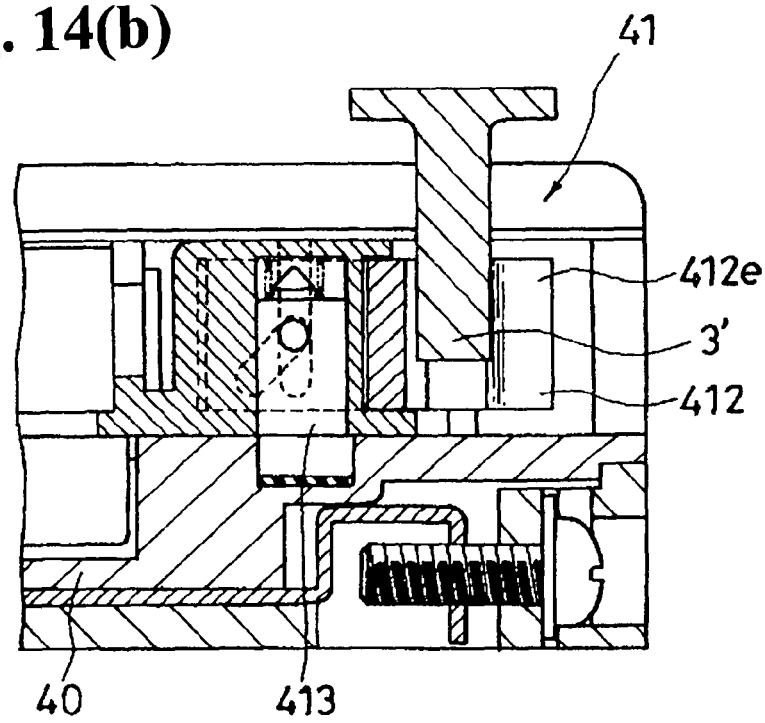
Figure 15A:
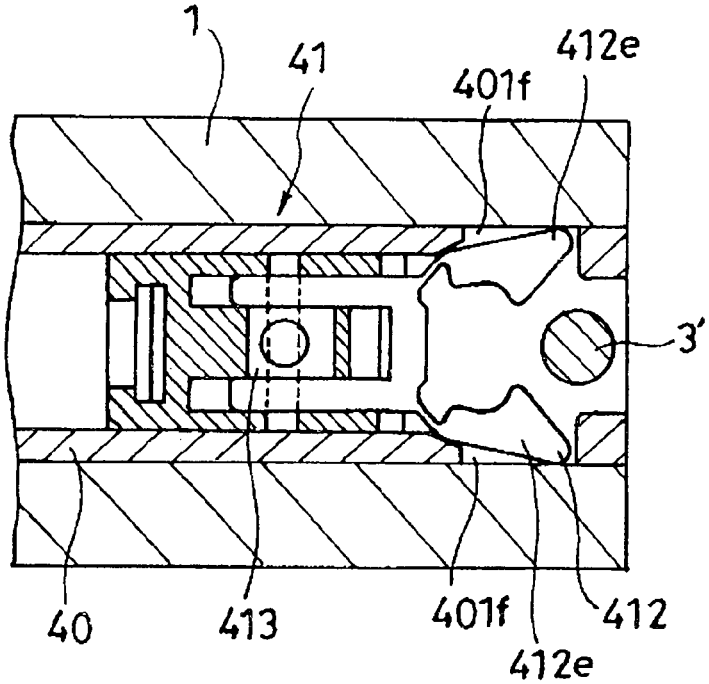
FIG. 15(*a*) is a cross sectional plan view of the essential parts, and FIG. 15(*b*) is a cross sectional side view of the essential parts, illustrating the part of the process of the operation of the latch unit 4'.
Figure 15B:
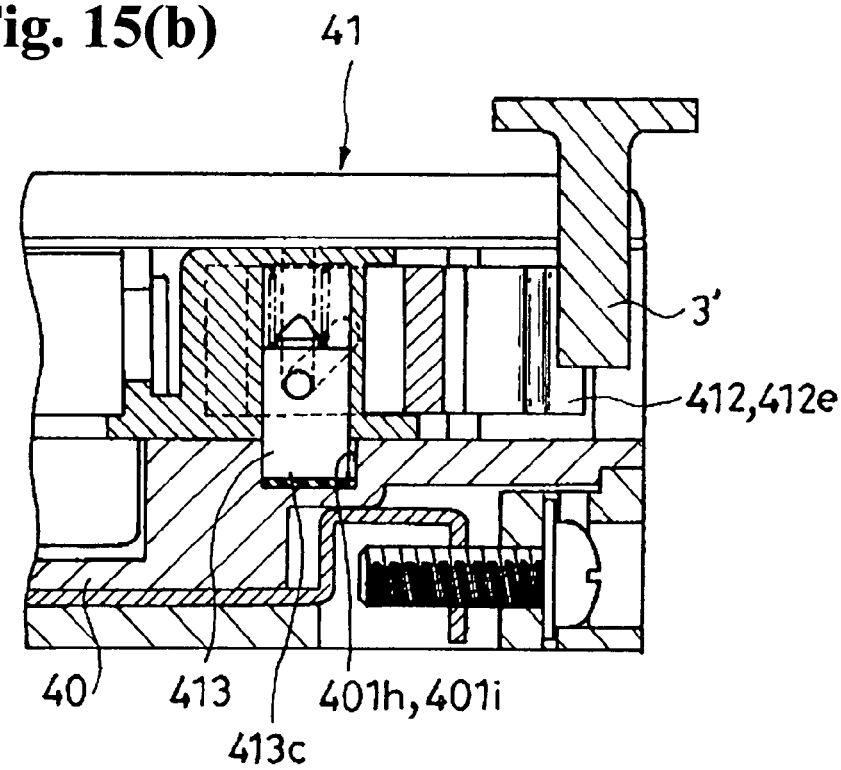

When the movable member 1 is moved forward to the predetermined position from the waiting state of the catcher 41, first, the striker member 3' enters further than the front ends 412*f* of the retaining pieces 412*e* of the retaining member 412 (FIGS. 9(*a*), 9(*b*)) and next, hits the retaining member 412, so that the retaining member 412 is moved back. (FIGS. 10(*a*), 10(*b*)) When the retaining member 412 is moved back, the lock member 413 moves to the non-engagement position by the second guide grooves 412*c*. (FIGS. 10(*a*), 10(*b*)) At the same time, the retaining pieces 412*e* are moved to the retention position and engaged with the striker member 3'. (FIGS. 10(*a*), 10(*b*)) Since the spring member 42 is stretched most in the waiting state, when the lock member 413 moves to the non-engagement position, the catcher 41 engaging and holding the striker member 3' moves or relatively moves inside the internal space 401*b* of the base 40. (FIGS. 11(*a*), 11(*b*)) In the example of the figures, without moving the catcher 41 engaging and holding the striker member 3', the base 40, i.e., the movable member 1 side automatically moves forward toward the right side of FIG. 4 by restoring the elasticity of the spring member 42. Accordingly, the movable member 1 can be automatically moved forward to the stopped position (FIG. 5) from the predetermined position (FIG. 4).

Also, when the movable member 1 which was automatically moved forward to the stopped position moves backward, the spring member 42 is elastically transformed again, and when the movable member 1 moves backward to the predetermined position, the lock member 413 moves to the engagement position by the urging force, and engages the engagement portion 401*h*. (FIGS. 14(*a*)-15(*b*)) This engagement restores the waiting state. When the backward movement of the movable member 1 continues further from this waiting state, the retaining member 412 goes forward and the retaining pieces 412*e* return to the non-retention position by the urging force. In the example of the figures, the retaining pieces 412*e* enter into the window holes 401*f* again. (FIGS. 15(*a*), 15(*b*)) As a result, the striker member 3' is disengaged from the retaining member 412, so that the movable member 1 can be moved backward further in front.

(Damper Appliance 43)

Also, in the embodiment, a damper appliance 43 which damps the movement or relative movement of the catcher 41, is built into the latch unit 4'.

In the example of the figures, the damper appliance 43 includes a cylinder 431; a piston not shown in the figures and dividing a space inside the cylinder 431 into two; and a rod 432 connected to the piston and extending backward from the back end of the cylinder 431. Viscous fluid such as silicon oil and the like is enclosed inside the cylinder 431 and especially. When the rod 432 is pushed forward and the piston is moved forward inside the cylinder 431, the viscous fluid imparts braking for the movement of the piston, i.e., the pushed-in operation of the rod 432. In the example of the figures, the front end part of the cylinder 431 of the damper appliance 43 with the above-mentioned structure is assembled to the upper part of the back end part of the slide base 411 of the catcher 41, and the back end of the rod 432 is fastened to the back end of the base main body 401. Accordingly, the damper appliance 43 is housed on the back side of the internal space 401*b* of the base 40 which is closed by a back upper lid 407.

Therefore, in the embodiment, the automatic forward movement of the movable member 1 accompanied by the movement or relative movement of the catcher 41 inside the base 40 by restoring the elasticity of the spring member 42 can be braked.

In the example of the figures, when the movable member 1 is moved to the predetermined position, the waiting state of the catcher 41 is released, and a space between the catcher 41 engaging and holding the striker member 3' and the back end of the base 40 is narrowed. Therefore, the space between the front end of the movable member 1 and the catcher 41 is widened, and the movable member 1 is moved forward for this amount. Also, the rod 432 is pushed into the cylinder 431 supported by the catcher 41.

(Adjuster Piece 44)

In the embodiment, the immovable member 2 includes the wide groove 21*a* along the moving direction x of the movable member 1 which houses the end part 1*a* along the moving direction x of the movable member 1; and a narrow groove 21*b* formed on the bottom of the wide groove 21*a* along the moving direction x of the movable member 1. Also, the latch unit 4' includes the adjuster piece 44 which can enter into the narrow groove 21*b* and adjust the movement in a direction intersecting in the moving direction x of the movable member 1.

In the example in the figures, the narrow groove 21*b* is formed in the approximately middle position of the width direction of the wide groove 21*a*, which is the bottom of the wide groove 21*a* housing the upper end part 11 of the sliding door 1' as the movable member 1. Supporting shafts 443 ranging between the pair of side walls 401*e*, 401*e* of the base main body 401 are formed in the upper part of the base main body 401 of the base 40 and in the approximately middle position of the length direction of the base main body 401. The supporting shafts 443 passes through holes 444, and the adjuster piece 44 is formed in the upper surface of a base plate 441 attached movably in a horizontal direction. In the example in the figures, a cylindrical projection 442 is formed on the undersurface of the base plate 441, and can be housed in the cam groove 403*f* formed in the side plate 403*e* of the linkage portion 403*c* of the operation plate 403. The cam groove 403*f* faces a direction diagonally intersecting the moving direction x of the movable member 1. The adjustment screw 402*b* which is located in the front end of the mount base 402 is rotated, and the operation plate 403 is moved back and forth, so that the adjuster piece 44 can be moved and adjusted in a direction perpendicular to the moving direction x of the movable member 1.

Accordingly, in the embodiment, the end portion 1*a* of the movable member 1 is housed in the wide groove 21*a* in such a way that both side faces 1*b*, 1*b* of the end portion 1*a* of the movable member 1 do not contact or strongly contact with the inner wall of the wide groove 21*a*, so that the movable member 1 can be moved forward and backward along the wide groove 21*a*. More specifically, if either one of both side faces 1*b*, 1*b* of the end portion 1*a* of the movable member 1 contacts the inner wall of the wide groove 21*a* due to distortion caused in the movable member 1 or immovable member 2, the adjuster piece 44 is moved and adjusted, thereby dissolving the contacting state. As a result, the movable member 1 can always automatically and appropriately move forward by an action of the spring member 42.

(Others)

Incidentally, in the example shown in FIGS. 16-18, in the base 40, the engagement between the lock member 413 and engagement portion 401*h* of the base 40 is disengaged by mistake in a state of not engaging with the striker member 3, and portions 401*m* wherein the retaining pieces 412*e* of the retaining member 412 of the catcher 41 which was completely moved inside the base 40 by the urging force of the spring member 42, are elastically transformed outwardly.

More specifically, in the example shown in FIGS. 16-18, cut-out parts are formed in the side walls of the base main body 401, and the portions 401*m* function as elastic pieces 401*n*.

Therefore, in this example, when the catcher 41 is completely moved in the state of not engaging and holding the striker member 3' by mistake as mentioned above, (FIG. 16) the movable member 1 is moved forward to the stopped position, and the striker member 3' is pushed against the retaining pieces 412*e* of the retaining member 412 which are positioned in the retention position by the inner walls of the base 40. Accordingly, after the retaining pieces 412*e* are moved into the non-retention position while the above-mentioned portions 401*m* of the base 40 are stretched outwardly, (FIG. 17) the retaining pieces 412*e* are positioned in the retaining position by restoring the elasticity at the position wherein the striker member 3' enters further than the front end 412*f* of the retaining pieces 412*e* (FIG. 18), and a regular operating state wherein the striker member 3' is engaged and held by the catcher 41 can be restored.

Example Wherein the Spring Member 42 is Used as the Compression Coil Spring 424

FIGS. 19, 20 show an example constituting an automatic forward movement mechanism using the spring member 42 as the compression coil spring 424. In this example, a spring end 425 of the compression coil spring 424 is fastened to the step surface 401*j* of the base main body 401, and the other spring end 426 of the compression coil spring 424 is fastened to the fixing portion 411*b* of the slide base 411 of the catcher 41 which is entered beneath through the cleavage groove 401*k* formed in the bottom wall 401*g* of the base main body 401.

In the example, when the movable member 1 is moved forward to the predetermined position from the state wherein the catcher 41 is in the waiting position, and the lock member 413 is moved into the non-retention position, the catcher 41 engaging and holding the striker member 3' is moved or relatively moved inside the internal space 401*b* of the base 40 by restoring the elasticity of the spring member 42 which is compressed the most in the waiting state. In the example in the figures, without moving the catcher 41 engaging and holding the striker member 3', the base 40, i.e., the movable member 1 side automatically moves forward toward the right side of FIG. 19 by restoring the elasticity of the spring member 42. Accordingly, the movable member 1 can be automatically moved forward to the stopped position (FIG. 20) from the predetermined position (FIG. 19).

(Sliding Door Mechanism)

If a sliding door mechanism is constituted such that either the striker member 3' or latch unit 4' explained above is provided on a sliding door 1' side and the other striker member 3' or latch unit 4' is provided on the opening 2' side which is closed by the sliding door 1', when the sliding door 1' is moved forward to the predetermined position, the sliding door 1' automatically moves after the predetermined position, so that the sliding door 1' can be moved forward to the stopped position, i.e., to a closed position wherein the front end 10 of the sliding door 1' hits the door stop portion 20. Accordingly, even if the force acted on the sliding door 1' during the closing operation of the sliding door 1' is small, as long as the sliding door 1' is moved forward to the predetermined position, the sliding door 1' can be moved to the stopped position. Also, even if the force acted on the sliding door 1' during the closing operation of the sliding door 1' is too large, the sliding door 1' can be controlled so as not to be bounced and moved backward.

(Drawer Mechanism)

Also, if a drawer mechanism is constituted such that either the striker member 3' or latch unit 4' explained above is provided on the drawer side and the other striker member 3' or latch unit 4' is provided on the main body side with the drawer, when the drawer is moved forward to the predetermined position, the drawer automatically moves after the predetermined position, so that the drawer can be moved forward to the stopped position, i.e., to a position wherein the drawer is completely housed in the main body. Accordingly, even if the force acted on the drawer during a pushed-in operation of the drawer is small, as long as the drawer is moved forward to the predetermined position, the drawer can be moved to the stopped position. Also, even if the force acted on the drawer during the pushed-in operation of the drawer is too large, the drawer can be controlled so as not to be bounced and moved backward.

The disclosure of Japanese Patent Application No. 2004-367268 filed on Dec. 20, 2004 is incorporated as a reference.

While the invention has been explained with reference to the specific embodiments of the invention, the explanation is illustrative and the invention is limited only by the appended claims.

What is claimed is:

1. A mechanism for allowing a movable member which was moved forward to a predetermined position to automatically move further forward to a stopped position comprising:

a first connecting member adapted to be provided in one of the movable member and an immovable member; and a second connecting member adapted to be provided in the other of the movable member and the immovable member, said second connecting member including a catcher for catching the first connecting member, said catcher having a retaining member for retaining and releasing the first connecting member and a lock member for holding the catcher in a waiting position, and an urging device for urging the catcher, said catcher being arranged to be able to move or relatively move along a moving direction of the movable member, and held in the waiting position by the lock member while receiving an urging force by the urging device toward a forward movement direction of the movable member so that when the movable member is moved to the predetermined position, the first connecting member is retained by the retaining member of the catcher; when the first connecting member is retained by the retaining member, the lock member releases the retaining member; upon releasing of the retaining member by the lock member, the movable member is automatically moved forward to the stopped position by the urging force of the urging device; and when the movable member which is in the stopped position is moved backward to the predetermined position, the retaining member of the catcher is held in the waiting position again by the lock member, and the first connecting member comes out of the catcher.

2. A mechanism according to claim 1, wherein the catcher further includes a slide base attached to the retaining member, a spring for urging the lock member to project outwardly from the slide base, and a device arranged among the slide base, the retaining member and the lock member so that when the retaining member is moved toward the slide base by engaging the first connecting member, the device allows the lock member to retract into the slide base.

3. A mechanism according to claim 2, wherein the device includes a first guide groove formed in the slide base, a second guide groove formed in the retaining member intersecting diagonally to the first guide groove, and an interlocking shaft passing through the first and second guide grooves.

4. A mechanism for allowing a movable member which was moved forward to a predetermined position to automatically move further forward to a stopped position comprising:

a striker member adapted to be provided in one of the movable member and an immovable member; and a latch unit adapted to be provided in the other of the movable member and the immovable member, and comprising:

a spring member, a catcher including a slide base, a retaining member for the striker member, and a lock member, and a base having an internal space which allows the catcher to move or relatively move along a moving direction of the movable member, a fixing portion for the movable member or immovable member, and a fixing portion for one end of the spring member, wherein the slide base includes first guide grooves, and a fixing portion of the other end of the spring member, the retaining member includes an assembled portion to the slide base at a back side thereof, second guide grooves on the back side which intersect diagonally to the first guide grooves, and retaining pieces which always project outwardly and are urged in a non-retention position on the front end sides, the lock member has a spring to urge the lock member toward an engagement position wherein the lock member is caught at an engagement portion of the base by the spring, and an interlocking shaft passing through the first guide grooves and second guide grooves, and the spring member is elastically transformed most in a waiting state wherein the lock member of the catcher is caught on the engagement portion of the base, and wherein said catcher is arranged such that when the movable member is moved to a predetermined position, the striker member hits the retaining member of the catcher which is in the waiting state, and the retaining member is moved back by slopes of the second guide grooves; the lock member is moved to a non-engagement position against an urging force of the spring; and the retaining pieces of the retaining member are moved in a retention position by being guided by inner walls of the base, and engaged with the striker member.

5. A mechanism according to claim 4, wherein said latch unit further comprises a damper for damping the movement or relative movement of the catcher.

6. A mechanism according to claim 4, wherein the immovable member includes a wide groove along the moving direction of the movable member which houses an end portion of the movable member along the moving direction thereof, and a narrow groove formed on a bottom of the wide groove along the moving direction of the movable member, and the latch unit includes an adjuster piece which enters the narrow groove and can adjust a movement in the direction intersecting the moving direction of the movable member.

7. A mechanism according to claim 4, wherein parts of the retaining pieces are formed to elastically deform outwardly at portions where the retaining pieces of the retaining member of the catcher which was completely moved inside the base by the urging force of the spring member contact upon disengagement between the lock member and the engagement portion of the base by mistake in a state of not engaging with the striker member.

8. A sliding door mechanism, comprising a sliding door and an opening side closed by the sliding door, wherein one of the striker member and latch unit according to claim 4 is provided on the sliding door side, and the other of the striker member and latch unit is provided on the opening side.

9. A drawer mechanism, comprising a drawer and a main body with the drawing, wherein one of the striker member and latch unit according to claim 4 is provided on the drawer, and the other of the striker member and latch unit is provided on the main body side.

* * * * *